US010234780B2

(12) United States Patent
Terada et al.

(10) Patent No.: US 10,234,780 B2
(45) Date of Patent: Mar. 19, 2019

(54) TONER FOR DEVELOPING ELECTROSTATIC CHARGE IMAGE AND METHOD FOR PREPARING THE SAME

(71) Applicant: Samsung Electronics Co., Ltd., Suwon-si (KR)

(72) Inventors: Akinori Terada, Yokohama (JP); Keiichi Ishikawa, Yokohama (JP); Kenichi Miyamoto, Yokohama (JP); Masahide Yamada, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/200,710

(22) Filed: Jul. 1, 2016

(65) Prior Publication Data

US 2017/0003611 A1 Jan. 5, 2017

(30) Foreign Application Priority Data

Jul. 2, 2015 (JP) ..... 2015-133331
Jan. 29, 2016 (KR) ..... 10-2016-0011958

(51) Int. Cl.
*G03G 9/093* (2006.01)
*G03G 9/087* (2006.01)
*G03G 9/08* (2006.01)

(52) U.S. Cl.
CPC ..... *G03G 9/09371* (2013.01); *G03G 9/0804* (2013.01); *G03G 9/08755* (2013.01); *G03G 9/08795* (2013.01); *G03G 9/08797* (2013.01); *G03G 9/09328* (2013.01); *G03G 9/09392* (2013.01)

(58) Field of Classification Search
CPC ..... G03G 9/09371; G03G 9/09328; G03G 9/09335; G03G 9/09378; G03G 9/08795; G03G 9/08797; G03G 9/08755
USPC ..... 430/110.2, 108.11, 108.3, 108.5, 109.4
See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 7,629,098 | B2 | 12/2009 | Matsumura et al. | |
| 7,695,886 | B2 | 4/2010 | Matsumura et al. | |
| 8,039,186 | B2 | 10/2011 | Sasaki et al. | |
| 8,268,525 | B2 | 9/2012 | Joo et al. | |
| 8,426,097 | B2 | 4/2013 | Shin et al. | |
| 8,598,300 | B2 | 12/2013 | Hishida et al. | |
| 8,642,239 | B2 | 2/2014 | Hong et al. | |
| 8,871,419 | B2 | 10/2014 | Hiraoka et al. | |
| 2009/0042121 | A1* | 2/2009 | Toizumi | G03G 9/0819 430/108.7 |
| 2010/0047705 | A1 | 2/2010 | Sasaki et al. | |
| 2010/0272471 | A1* | 10/2010 | Yang | G03G 9/0819 399/222 |
| 2011/0143275 | A1 | 6/2011 | Obata et al. | |
| 2013/0171557 | A1 | 7/2013 | Watanabe et al. | |

FOREIGN PATENT DOCUMENTS

| | | | |
|---|---|---|---|
| JP | 63-282752 | A | 11/1988 |
| JP | 6-250439 | A | 9/1994 |
| JP | 2006-323125 | A | 11/2006 |
| JP | 2007-114627 | A | 5/2007 |
| JP | 2007-225838 | A | 9/2007 |
| JP | 2008-256913 | A | 10/2008 |
| JP | 2009-204788 | A | 9/2009 |
| JP | 2010-175735 | A | 8/2010 |
| JP | 2011-148913 | A | 8/2011 |
| JP | 2012-93704 | A | 5/2012 |
| JP | 2012-159840 | A | 8/2012 |
| JP | 2013-3499 | A | 1/2013 |
| JP | 2014-81592 | A | 5/2014 |
| JP | 2015-4869 | A | 1/2015 |
| JP | 2015-82070 | A | 4/2015 |
| KR | 10-0806767 | B1 | 2/2008 |
| KR | 10-2010-0089336 | A | 8/2010 |
| KR | 10-1426323 | B1 | 8/2014 |
| KR | 10-1518803 | B1 | 5/2015 |

OTHER PUBLICATIONS

Whelan, T., ed., Polymer Technology Dictionary, Chapman & Hall, London (1994), p. 256. (Year: 1994).*

* cited by examiner

*Primary Examiner* — Janis L Dote
(74) *Attorney, Agent, or Firm* — NSIP Law

(57) ABSTRACT

A toner for developing an electrostatic charge image includes three or more elements selected from a group including an iron element, a silicon element, a sulfur element and a fluorine element and a binder resin including an amorphous polyester-based resin.

15 Claims, No Drawings

TONER FOR DEVELOPING ELECTROSTATIC CHARGE IMAGE AND METHOD FOR PREPARING THE SAME

CROSS-REFERENCE TO RELATED APPLICATIONS

This application claims the benefit under 35 USC 119(a) of Japaneses Patent Application No. 2015-133331 filed on Jul. 2, 2015 in the Japaneses Intellectual Property Office, and Korean Patent Application No. 10-2016-0011958 filed on Jan. 29, 2016 in the Korean Intellectual Property Office, the entire contents of both of which are incorporated herein by reference.

BACKGROUND

1. Field

The following description relates to a toner for developing an electrostatic charge image and a method of manufacturing the same.

2. Description of Related Art

Methods of visualizing image information by utilizing electrostatic charge are currently used in various fields. An example of such a method is an electrophotographic method in which, after uniformly charging a photoreceptor surface, an electrostatic charge image is formed on the photoreceptor surface, and then an electrostatic latent image is developed by using a developer. The developer may include a toner, and the developed image is referred to a toner image. This toner image is transferred and fused to a recording medium to form a stable image. As the developer, a two-component developer that includes a toner and a carrier may be used. In the alternative, a one-component developer that includes a magnetic toner or a non-magnetic toner alone may be used. In recent years, to reduce power consumption and to save energy, the toner image is often fused at a low temperature. To fuse the toner image at the low temperature, a method for lowering a glass transition temperature of a binder resin of the toner may be used. Also, according to a method of manufacturing a toner, a kneading and grinding method in which a thermoplastic resin is melt-kneaded together with colorants such as a pigment, charge control agents, and release agents such as a wax, and is milled and classified after cooling, may be used. However, in a common kneading and grinding method, a toner shape and a toner surface structure are irregular. As a result, a reliability deterioration such as display quality deterioration due to a charge deterioration of the developer, toner scattering, and developing property deterioration is caused. Accordingly, in recent years, a method of manufacturing the toner by an emulsion polymerization aggregation method capable of intensively controlling the toner shape and the toner surface structure has been proposed. JP Patent Publication Nos. 1988-282752 and 1994-250439 discuss examples of toner manufacturing methods. According to a toner manufacturing method, at least a resin particulate dispersion solution manufactured by the emulsion polymerization and a colorant particle dispersion solution in which the colorant is dispersed in the solvent are mixed, and an aggregation material corresponding to a toner particle size is formed. Next, the aggregation material is heated to be fused and coalesced, and a toner particle of a desired particle size is obtained. According to this manufacturing method, a small particle size of the toner particle is not only facilitated, but also an excellent toner is obtained in a particle distribution. As the binder resin of the toner, a polyester resin having an excellent fixability and permanence has been generally used. In general, it is necessary to synthesis the polyester resin at a high temperature of more than 200° C., and recently, from a point of view of reducing an environmental impact, to reduce energy consumed in the toner manufacture process, polymerization of the polyester resin at a low temperature has been studied.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. In one general aspect, a toner for developing an electrostatic charge image includes three or more elements selected from a group consisting of an iron element, a silicon element, a sulfur element, and a fluorine element, wherein, when included, a content of the iron element in the toner is in a range of $1.0\times10^3$ to $1.0\times10^4$ ppm, a content of the silicon element in the toner is in a range of $1.0\times10^3$ to $8.0\times10^3$ ppm, a content of the sulfur element in the toner is in a range of 500 to 3,000 ppm, and a content of the fluorine element is in a range of $1.0\times10^3$ to $1.0\times10^4$ ppm; and a binder resin comprising an amorphous polyester-based resin, wherein: an aromatic ring concentration of the amorphous polyester-based resin is in a range of 4.5 to 5.8 mol/kg; a weight average molecular weight (MW) of the amorphous polyester-based resin is in a range of 7,000 to 50,000; a glass transition temperature (Tg) of the amorphous polyester-based resin is in a range of 50 to 70° C.; and if a weight average molecular weight (MW) of the amorphous polyester-based resin is in a range of 7,000 or more to less than 14,000, Equation 1 is satisfied, and if the weight average molecular weight (MW) is in a range of 14,000 or more to 50,000 or less, Equation 2 is satisfied:

$$Tg=7.26\times\ln(MW)+a(\text{where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

The amorphous polyester-based resin may have a polycarboxylic acid component as a structural unit, and the polycarboxylic acid component may have a substituent group corresponding to three or more carboxyl groups.

The amorphous polyester-based resin may include a structural unit represented by one selected from a group consisting of Formulae 1 to 7:

(Formula 1)

(1)

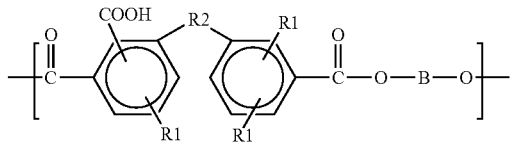

wherein: R1 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group; R2 is a carbonyl group, a sulfonyl group, or an oxygen atom; and B is a divalent substituted or unsubstituted linear aliphatic hydrocarbon group, a divalent substituted or unsubstituted branched aliphatic hydrocarbon group, a divalent substituted or unsubstituted cyclic aliphatic hydrocarbon group, a divalent substituted or unsubstituted aromatic hydrocarbon group, a substituted or unsubstituted diphenylmethylene group, a divalent functional group having a divalent substituted or unsubstituted linear aliphatic hydrocarbon group at both ends and an ester bond at an inside, a divalent functional group having a divalent substituted or unsubstituted linear aliphatic hydrocarbon group at both ends and an ester bond and an urethane bond at an inside, a divalent functional group having a divalent substituted or unsubstituted branched aliphatic hydrocarbon group at both ends and an ester bond at an inside, a divalent functional group having a divalent substituted or unsubstituted branched aliphatic hydrocarbon group at both ends and having an ester bond and urethane bond at an inside, a divalent functional group having a divalent substituted or unsubstituted cyclic aliphatic hydrocarbon group at both ends and an ester bond at an inside, a divalent functional group having a divalent substituted or unsubstituted cyclic aliphatic hydrocarbon group at both ends and having an ester bond and urethane bond at an inside, a divalent functional group having a substituted or unsubstituted aromatic hydrocarbon group at both ends and having an ester bond at an inside, a functional group having a substituted or unsubstituted aromatic hydrocarbon group at both e ends and having an ester bond and urethane bond at the inside, a divalent functional group having a substituted or unsubstituted diphenylmethylene group at both ends and having an ester bond at an inside, or a divalent functional group having a substituted or unsubstituted diphenylmethylene group at both ends and having an ester bond and urethane bond at an inside, (Formula 2)

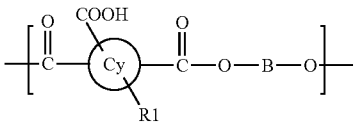

(2)

wherein: Cy is a saturated 4 to 6 atom ring, an unsaturated 4 to 6 atom ring, or a biphenyl group; and R1 and B are the same as in Formula 1, (Formula 3)

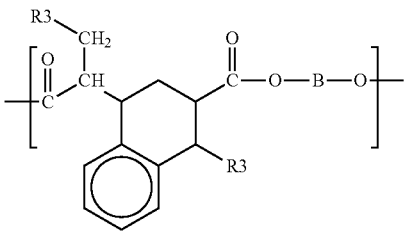

(3)

wherein: one R3 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group; another R3 is a carboxyl group; and B is the same as in Formula 1, (Formula 4)

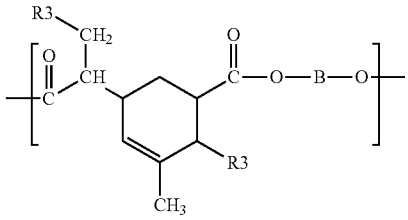

(4)

wherein: R3 is the same as in Formula 3; and B is the same as in Formula 1, (Formula 5)

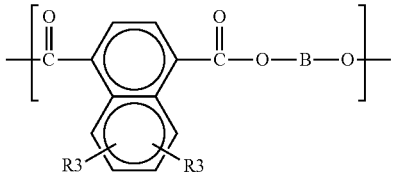

(5)

wherein, R3 and B are the same as in Formula 4, (Formula 6)

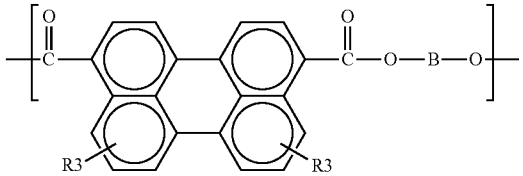

(6)

wherein, R3 and B are the same as in Formula 4, (Formula 7)

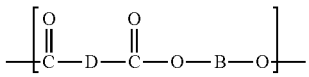

(7)

wherein: D is a divalent saturated or unsaturated linear or branched aliphatic hydrocarbon group of which at least one hydrogen atom is substituted by a carboxyl group; and B is the same as in Formula 1.

B may have a substituent group, and the substituent group may be a hydrocarbon group with a carbon number of 1 to 10.

A content of the structural unit in the amorphous polyester-based resin may be in a range of from 0.02 mol/kg to 0.35 mol/kg.

The binder resin may include a crystalline polyester resin. An endothermic amount in the fusing of the crystalline polyester resin as determined by differential scanning calorimetry (DSC) may be in a range of 2.0 to 10.0 W/g. A weight average molecular weight of the crystalline polyester resin may be in a range of 5,000 to 15,000. In an endothermic curve of the differential scanning calorimeter measurement, a difference between an endothermic start temperature and an endothermic peak temperature of the crystalline polyester resin when the temperature is increased is in a range of 3 to 5° C. The crystalline polyester resin may include a sulfur element, a fluorine element or both. A content of the crystalline polyester resin having the weight average molecular weight 1,000 or less may be in a range of from 1% to less than 10%.

The toner for developing the electrostatic charge image comprises a coating layer provided to the outer surface. The coating layer may include the amorphous polyester-based resin.

The coating layer may have a thickness of 0.2 to 1.0 μm.

The toner for developing the electrostatic charge image may have an acid value of 3 mgKOH/g to 25 mgKOH/g.

A volume average particle size may be in a range of 3 to 9 μm. A presence amount of particles having a particle size 3 μm or less as a number average particle size may be in a range of 3 number percent or less. A ratio of the presence amount of the particles having the particle size of 3 μm or less to the presence amount of the particles having the particle size of 1 μm or less as the number average particle size may be in a range of 2.0 to 4.0.

In another general aspect, a method of manufacturing a toner for developing an electrostatic charge image involves: an amorphous polyester-based resin synthesis process in which a first polycarboxylic acid component and a polyol component are dehydration-condensed at a temperature of 150° C. or less in a presence of a catalyst, wherein (i) a resin obtained by the dehydration condensation urethane-extends in a presence of the polyisocyanate component, then extends by the second polycarboxylic acid component having a substituent group corresponding to three or more carboxyl groups, and the amorphous polyester-based resin is synthesized, or (ii) the resin obtained by the dehydration condensation extends by the second polycarboxylic acid component having a substituent group corresponding to three or more carboxyl groups, then urethane-extends in the presence of the polyisocyanate component, such that the amorphous polyester-based resin is synthesized;

an amorphous polyester-based resin latex formation process of forming a latex of the amorphous polyester-based resin; a crystalline polyester resin synthesis process in which an aliphatic polycarboxylic acid component and an aliphatic polyol component are dehydration-condensed at a temperature of 100° C. or less in a presence of a catalyst, and the crystalline polyester resin is synthesized;

a crystalline polyester resin latex formation process of forming a latex of the crystalline polyester resin;

a mixture solution formation process of mixing at least the amorphous polyester-based resin latex and the crystalline polyester resin latex to form the mixture solution; a first aggregation particle formation process in which the amorphous polyester-based resin and the crystalline polyester resin are aggregated by adding a flocculant to the mixture solution to form the first aggregation particle;

a coated aggregation particle formation process providing a coating layer formed of the amorphous polyester-based resin on the surface of the first aggregation particle to form a coated aggregation particle; and a fusion unity process fusion-uniting the coated aggregation particle at a temperature higher than the glass transition temperature of the amorphous polyester-based resin. The aromatic ring concentration of the amorphous polyester-based resin may be in a range of 4.5 to 5.8 mol/kg. The weight average molecular weight (MW) of the amorphous polyester-based resin may be in a range of 7,000 to 50,000. The glass transition temperature (Tg) of the amorphous polyester-based resin may be in a range of 50 to 70° C. Equation 1 may be satisfied if the weight average molecular weight (MW) of the amorphous polyester-based resin is in a range from 7,000 or more to less than 14,000, and Equation 2 may be satisfied if the weight average molecular weight (MW) of the amorphous polyester-based resin is in a range from 14,000 or more to 50,000 or less. An endothermic amount in the fusing of the crystalline polyester resin as determined by the differential scanning calorimetry may be in a range of 2.0 to 10.0 W/g. A weight average molecular weight of the crystalline polyester resin may be in a range of 5,000 to 15,000. For the endothermic curve found by the differential scanning calorimetry, the difference between the endothermic start temperature and the endothermic peak temperature of the crystalline polyester resin while increasing the temperature may be in a range of 3 to 5° C. The crystalline polyester resin may include a sulfur element, a fluorine element or both. The content of the crystalline polyester resin having a weight average molecular weight of 1,000 or less may be in a range of from 1% to less than 10%. The catalyst may include one or more types of elements selected by including at least sulfur element in the sulfur element and the fluorine element, and the flocculant may include the iron element and the silicon element:

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

In another general aspect, a toner for developing an electrostatic charge image includes a binder resin including an amorphous polyester-based resin, the amorphous polyester-based resin having an aromatic ring concentration in a range of 4.5 to 5.8 mol/kg, a weight average molecular weight (MW) of the amorphous polyester-based resin being in a range of 7,000 to 50,000, and a glass transition temperature (Tg) of the amorphous polyester-based resin being in a range of 50 to 70° C.; and three or more elements comprising iron, silicon and sulfur, wherein an iron element content in the toner is in a range of $1.0\times10^3$ to $1.0\times10^4$ ppm, a silicon element content in the toner is in a range of $1.0\times10^3$ to $8.0\times10^3$ ppm, and a sulfur element content in the toner is in a range of 500 to 3,000 ppm.

The weight average molecular weight (MW) of the amorphous polyester-based resin may be in a range of 7,000 or more to less than 14,000, and the amorphous polyester-based resin may satisfy Equation 1:

$$Tg=7.26\times\ln(MW)+a \text{ (where } -19.33\leq a\leq -4.29). \quad \text{(Equation 1)}$$

The weight average molecular weight (MW) of the amorphous polyester-based resin may be in a range of 14,000 or more to 50,000 or less, and the amorphous polyester-based resin may satisfy Equation 2:

$$Tg=2.67\times\ln(MW)+b \text{ (where } 21.07\leq b\leq 39.48). \quad \text{(Equation 2)}$$

The general aspect of the toner may further include fluorine, and a fluorine element content in the toner may be in a range of $1.0\times10^3$ to $1.0\times10^4$ ppm.

Other features and aspects will be apparent from the following detailed description, the drawings, and the claims.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

As described above, for the fusing at the low temperature, the method of lowering the glass transition temperature of the toner binder resin has been proposed; however, if the glass transition temperature of the toner binder resin is lowered, since the toner is aggregated inside a printing press or during transport, the preservability is deteriorated.

Also, as described above, the option of performing a polymerization at a low temperature of the polyester resin has been studied; however, in a toner using a conventional low temperature polymerization polyester resin, the low temperature fixability and the preservability may not be attained.

An embodiment according to the present description relates to a toner for developing an electrostatic charge image having an excellent low temperature fixability and excellent preservability and reducing the energy consumption when manufacturing the toner. Another embodiment relates to a method of manufacturing the same.

The present inventor, through repeated studies, obtained a toner for developing an electrostatic charge image having an excellent low temperature fixability and excellent preservability by controlling an aromatic ring concentration, a weight average molecular weight, and a glass transition temperature of the polyester resin used as a binder resin and a metal amount in the toner. Also, in the synthesis of the polyester resin used as the binder resin, by adjusting a monomer type and a combination ratio, and a type of a catalyst used, thereby reducing the synthesis temperature to less than 150° C., it has been determined that an energy consumption in the binder resin synthesis may be significantly reduced.

An embodiment of the present application has been made in accordance with this finding. Accordingly, a toner for developing an electrostatic charge image having an excellent low temperature fixability and excellent preservability and reducing an energy consumption amount in the toner manufacturing may be manufactured.

Hereinafter various embodiments will be described in detail.

However, a following description relates to a first embodiment, and the present description is not limited to the configuration of the first embodiment.

Toner for Developinq an Electrostatic Charge Image

An example of a toner for developing the electrostatic charge image includes a binder resin.

As the binder resin, an amorphous polyester-based resin having following Characteristics (1) to (4) may be used. In the present specification, this polyester resin is referred to as a first polyester resin.

The Characteristics (1) to (4) include the following:

(1) an aromatic ring concentration is in a range of 4.5 to 5.8 mol/kg;

(2) a weight average molecular weight (MW) is in a range of 7,000 to 50,000;

(3) a glass transition temperature (Tg) is in a range of 50 to 70° C.; and (4) when the weight average molecular weight (MW) is 7,000 or more to less than 14,000, Equation 1 is satisfied, and when the weight average molecular weight (MW) is 14,000 or more to 50,000, Equation 2 is satisfied.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

Characteristic (1) of the first polyester resin may be controlled by controlling a type of a polycarboxylic acid component, a polyol component, and a polyisocyanate component, used as a monomer, or a combination ratio of the polycarboxylic acid component, the polyol component, and the polyisocyanate component.

The aromatic ring concentration of the first polyester resin, as described above, is in the range of 4.5 to 5.8 mol/kg, for example, 4.5 to 5.5 mol/kg. If the aromatic ring concentration is in the range of 4.5 to 5.8 mol/kg, the toner for developing the electrostatic charge image of which the low temperature fixability and the preservability are excellent may be obtained. If the aromatic ring concentration exceeds 5.8 mol/kg, the low temperature fixability may deteriorate. If the aromatic ring concentration is less than 4.5 mol/kg, the preservability may deteriorate such that it is not preferable. The aromatic ring concentration of the first polyester resin, as described later, may be obtained by analyzing an ultraviolet ray absorption spectrum.

Characteristic (2) of the first polyester resin may be controlled by selecting the type of a polycarboxylic acid component and a polyol component, used as the monomer, or the combination ratio of the polycarboxylic acid component and the polyol component.

The weight average molecular weight (MW) of the first polyester resin, as described above, is in the range of 7,000 to 50,000, for example, 10,000 to 43,000. If the weight average molecular weight is in the range of 7,000 to 50,000, the toner for developing the electrostatic charge image of which the low temperature fixability and the preservability are excellent may be obtained. If the weight average molecular weight (MW) exceeds 50,000, the low temperature fixability deteriorated. If the weight average molecular weight (MW) is less than 7,000, the preservability may deteriorate.

The weight average molecular weight of the first polyester resin, as described later, may be obtained by gel permeation chromatography (GPC) measurement.

Characteristic (3) of the first polyester resin may be controlled by selecting the type of a polycarboxylic acid component, a polyol component, and a polyisocyanate component, used as the monomer, or the combination ratio of the polycarboxylic acid component, the polyol component, and the polyisocyanate component.

The glass transition temperature (Tg) of the first polyester resin, as described above, is in the range of 50 to 70° C., for example, 55 to 65° C. If the glass transition temperature (Tg) is in the range of 50 to 70° C., the toner for developing the electrostatic charge image having an excellent low temperature fixability and excellent preservability may be obtained. If the glass transition temperature (Tg) exceeds 70° C., the low temperature fixability is deteriorated. If the glass transition temperature (Tg) is less than 50° C., the preservability and the charge property are deteriorated.

The glass transition temperature of the first polyester resin, as described later, may be obtained from a differential scanning calorimetric curve obtained by differential scanning calorimeter measurement.

Characteristic (4) of the first polyester resin may be controlled by selecting the type of the polycarboxylic acid component, the polyol component, and the polyisocyanate component, used as the monomer, or adjusting the combination ratio of the polycarboxylic acid component, the polyol component, and the polyisocyanate component.

The weight average molecular weight of the first polyester resin and the glass transition temperature satisfy Equation 1 when the weight average molecular weight (MW) is 7,000 or more to less than 14,000, and satisfy Equation 2 when the weight average molecular weight (MW) is 14,000 or more to 50,000. When Equation 1 or Equation 2 is satisfied, the toner for developing the electrostatic charge image having an excellent low temperature fixability and excellent preservability may be obtained.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

The first polyester resin may include a structural unit represented by any one among Chemical Formulae 1 to 7 below. The structural unit represented by Formulae 1 to 7 has a carboxyl group at a side chain. Accordingly, by including the structural unit represented by Formulae 1 to 7, the glass transition temperature may be controlled in the range of 50 to 70° C.

(Formula 1)

(Formula 1)

(1)

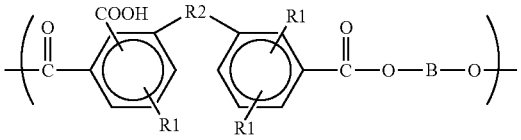

In Formula 1, R1 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group, and R2 is a carbonyl group, a sulfonyl group, or an oxygen atom. B is a divalent substituted or unsubstituted linear aliphatic hydrocarbon group, a divalent substituted or unsubstituted branched aliphatic hydrocarbon group, a divalent substituted or unsubstituted cyclic aliphatic hydrocarbon group, a divalent substituted or unsubstituted aromatic hydrocarbon group, a substituted or unsubstituted diphenylmethylene group, a divalent functional group having a divalent substituted or unsubstituted linear aliphatic hydrocarbon group at both ends and an ester bond at an inside, a divalent functional group having a divalent substituted or unsubstituted linear aliphatic hydrocarbon group at both ends and an ester bond and urethane bond at an inside, a divalent functional group having a divalent substituted or unsubstituted branched aliphatic hydrocarbon group at both ends and an ester bond at an inside, a divalent functional group having a divalent substituted or unsubstituted branched aliphatic hydrocarbon group at both ends and having an ester bond and urethane bond at an inside, a divalent functional group having a divalent substituted or unsubstituted cyclic aliphatic hydrocarbon group at both ends and an ester bond at an inside, a divalent functional group having a substituted or unsubstituted cyclic aliphatic hydrocarbon group at both ends and having an ester bond and urethane bond at the inside, a divalent functional group having a divalent substituted or unsubstituted aromatic hydrocarbon group at both ends and having an ester bond at an inside, a divalent functional group having a divalent substituted or unsubstituted aromatic hydrocarbon group at both ends and having an ester bond and urethane bond at an inside, a divalent functional group having a substituted or unsubstituted diphenylmethylene group at both ends and having an ester bond at an inside, or a divalent functional group having a substituted or unsubstituted diphenylmethylene group at both ends and having an ester bond and urethane bond at an inside. In other words, B may be a divalent substituted or unsubstituted linear aliphatic hydrocarbon group, a divalent substituted or unsubstituted branched aliphatic hydrocarbon group, a divalent substituted or unsubstituted cyclic aliphatic hydrocarbon group, a divalent substituted or unsubstituted aromatic hydrocarbon group, or a substituted or unsubstituted diphenylmethylene group (hereinafter referred to as the first functional group), may be a divalent functional group having a first functional group at both ends and having an ester bond at an inside (i.e., between both ends), or may be a divalent functional group having a first function group at both ends and having an ester bond and urethane bond at an inside. Also, when B has a substituent group, the substituent group thereof may be a hydrocarbon group of a carbon number of 1 to 10.

(Formula 2)

(2)

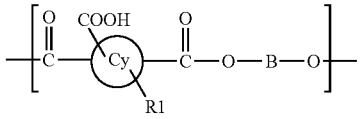

In Formula 2, Cy is a saturated 4 to 6 atom ring, an unsaturated 4 to 6 atom ring, or a biphenyl group, and R1 and B are the same as in Formula 1.

(Formula 3)

(3)

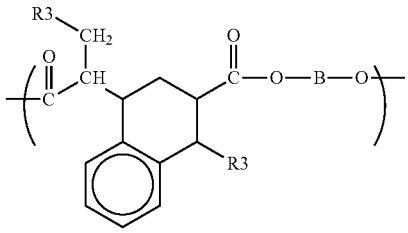

In Formula 3, one R3 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group, the other R3 is a carboxyl group, and B is the same as in Formula 1.

(Formula 4)

(4)

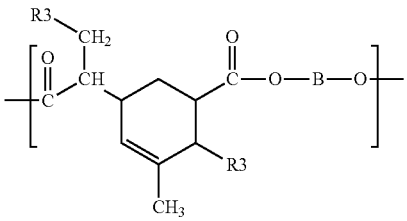

In Formula 4, R3 is the same as in Formula 3, and B is the same as in Formula 1.

(Formula 5)

(5)

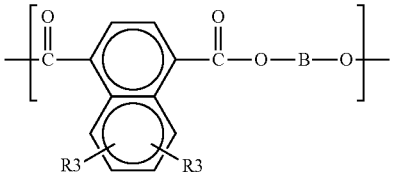

In Formula 5, R3 and B are the same as in Formula 4.

(Formula 6)

(6)

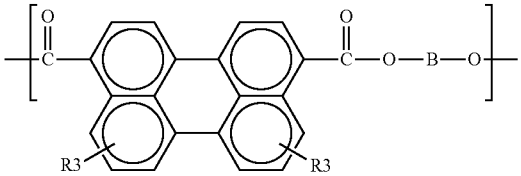

In Formula 6, R3 and B are the same as in Formula 4.

(Formula 7)

(7)

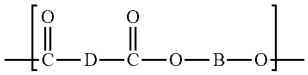

In Formula 7, D is a divalent saturated or unsaturated linear or branched aliphatic hydrocarbon group of which at least one hydrogen atom is substituted by a carboxyl group, and B is the same as in Formula 1.

The first polyester resin may include the structural unit represented by Formulae 1 to 7 with the range of 0.02 to 0.35 mol/kg, for example, 0.08 to 0.3 mol/kg. If a content of the structural unit is in the range of 0.02 to 0.35 mol/kg, the glass transition temperature may be controlled in the range of 50 to 70° C. If the content of the structural unit exceeds 0.35 mol/kg, the glass transition temperature is increased. If the content of the structural unit is less than 0.02 mol/kg, the glass transition temperature is decreased.

The content of the structural unit represented by Formulae 1 to 7 of the first polyester resin may be controlled by selecting the type of a polycarboxylic acid component and a polyol component, used as the monomer, or adjusting the combination ratio of the polycarboxylic acid component and the polyol component.

The first polyester resin may be synthesized by dehydration-condensing the first polycarboxylic acid component and the polyol component, (i) by urethane-extending the resin obtained by the dehydration condensation in the presence of the polyisocyanate component, and then extending the resin by the second polycarboxylic acid component, or (ii) by extending the resin obtained by the dehydration condensation by the second polycarboxylic acid component, and then urethane-extending the resin in the presence of the polyisocyanate component.

As the first polycarboxylic acid component capable of being used for forming the first polyester resin, it is not particularly limited, however one having a substituent group corresponding to two carboxyl groups may be used. When having the substituent group corresponding to two carboxyl group, for example, there may be a case of having two carboxyl groups and a case of having one acid anhydride group. As the first polycarboxylic acid component capable of being used for forming the first polyester resin, a general organic polycarboxylic acid having the substituent group corresponding to two carboxyl groups such as an aliphatic carboxylic acid, an aromatic carboxylic acid, and an acid anhydride thereof, and a lower alkyl (with a carbon number of 1 to 4) ester thereof may be used. As a detailed example, as the aliphatic (optionally including a local ring) dicarboxylic acid, an alkane dicarboxylic acid with a carbon number of 2 to 50 (an oxalic acid, a malonic acid, a succinic acid, an adipic acid, a lepargylic acid, a sebacic acid, and the like), an alkene dicarboxylic acid with a carbon number of 4 to 50 (an alkenyl succinic acid such as a dodecenylsuccinic acid, a maleic acid, a fumaric acid, a citraconic acid, a mesaconic acid, an itaconic acid, and a glutaconic acid) may be used. As the aromatic dicarboxylic acid, an aromatic dicarboxylic acid with a carbon number of 8 to 36 (a phthalic acid, an isophthalic acid, a terephthalic acid, a naphthalene dicarboxylic acid, and the like) and an acid anhydride and a lower alkyl (with a carbon number of 1 to 4) ester thereof may be used.

The second polycarboxylic acid component capable of being used to form the first polyester resin may be to have the substituent group corresponding to three or more carboxyl groups. As the second polycarboxylic acid component, when using the substituent group corresponding to three or more carboxyl groups, in the structural unit of the first polyester resin, a structure derived from the polycarboxylic acid component having the substituent group corresponding to three or more carboxyl groups is increased. As the case of having the substituent group corresponding to three or more carboxyl groups, for example, there may be a case of having three carboxyl groups, a case of having one acid anhydride group and one carboxyl group, and a case of having two acid anhydride groups. As the second polycarboxylic acid component capable of being used to form the first polyester resin, there may be a general organic polycarboxylic acid having the substituent group corresponding to three or more carboxyl groups. As a detailed example, trimellitic anhydride, pyromellitic dianhydride, 4,4'-biphthalic acid dianhydride, 3,3',4,4'-benzophenone tetracarboxylic dianhydride, 4-(2,5-dioxo tetrahydrofuran-3-yl)-1,2,3,4-tetrahydronaphthalene-1,2-dicarboxylic acid anhydride, naphthalene-1,4,5,8-tetracarboxylic acid dianhydride, meso-butane-1,2,3,4-tetracarboxylic acid dianhydride, 1,3,5-benzenetricarboxylic acid, 3,3',4,4'-diphenylsulfone tetracarboxylic dianhydride, 4,4'-oxydiphthalic anhydride, 1,2,3,4-cyclopentane tetracarboxylic acid dianhydride, 1,2,4,5-cyclohexane tetracarboxylic acid dianhydride, 1,2,3,4-cyclobutane tetracarboxylic dianhydride, 5-(2,5-dioxo tetrahydrofuryl)-3-methyl-3-cyclohexene-1,2-dicarboxylic anhydride, or 3,4,9,10-perylene tetracarboxylic acid dianhydride may be used. If the trimellitic acid anhydride is used, the first polyester resin including the structural unit represented by Formula 2 is obtained. If the pyromellitic acid dianhydride is used, the first polyester resin including the structural unit represented by Formula 2 is obtained. If the 4,4'-biphthalic acid dianhydride is used, the first polyester resin including the structural unit represented by Formula 2 is obtained. If the 3,3',4,4'-benzophenone tetracarboxylic dianhydride is used, the first polyester resin including the structural unit represented by Formula 1 is obtained. If the 4-(2,5-dioxo tetrahydrofuran-3-yl)-1,2,3,4-tetrahydronaphthalene-1,2-dicarboxylic acid anhydride is used, the first polyester resin including the structural unit represented by Formula 3 is obtained. If the naphthalene-1,4,5,8-tetracarboxylic acid dianhydride is used, the first polyester resin including the structural unit represented by Formula 5 is obtained. If the meso-butane-1,2,3,4-tetracarboxylic acid dianhydride is used, the first polyester resin including the structural unit represented by Formula 7 is obtained. If the 1,3,5-benzenetricarboxylic acid is used, the first polyester resin including the structural unit represented by Formula 2 is obtained. If the 3,3',4,4'-diphenylsulfone tetracarboxylic dianhydride is used, the first polyester resin including the structural unit represented by Formula 1 is obtained. If the 4,4'-oxydiphthalic anhydride is used, the first polyester resin including the structural unit represented by Formula 1 is obtained. If the 1,2,3,4-cyclopentane tetracarboxylic acid dianhydride is used, the first polyester resin including the structural unit represented by Formula 2 is obtained. If the 1,2,4,5-cyclohexane tetracarboxylic acid dianhydride is used, the first polyester resin including the structural unit represented by Formula 2 is obtained. If the 1,2,3,4-cyclobutane tetracarboxylic dianhydride is used, the first polyester resin including the structural unit represented by Formula 2 is obtained. If the 5-(2,5-dioxo tetrahydrofuryl)-3-methyl-3-cyclohexene-1,2-dicarboxylic anhydride is used, the first polyester resin including the structural unit represented by Formula 4 is obtained. If the 3,4,9,10-perylene tetracarboxylic acid dianhydride is used, the first polyester resin including the structural unit represented by Formula 6 is obtained.

As the polyol component capable of being used to form the first polyester resin, it is not particularly limited. For example, an aliphatic diol with a carbon number of 2-36 (ethylene glycol, 1,2-propylene glycol, 1,3-propylene glycol, 1,4-butanediol, 2,3-butanediol, 1,5-pentanediol, 2,3-pentanediol, 1,6-hexanediol, 2,3-hexanediol, 3,4-hexanediol, neopentylglycol, 1,7-heptanediol, dodecanediol, and the like); a polyalkylene ether glycol with a carbon number of 4 to 36 (diethylene glycol, dipropylene glycol, polyethylene glycol, polypropylene glycol, and the like); an adduct of an alkylene oxide with a carbon number of 2 to 4 (hereinafter abbreviated to AO) [ethylene oxide (hereinafter abbreviated to EO), a propylene oxide (hereinafter abbreviated to PO), a butylene oxide, etc.] of the aliphatic diol with a carbon number of 2 to 36 (addition moles: 2 to 30); an aliphatic ring type diol with a carbon number of 6 to 36 (1,4-cyclohexane dimethanol, hydrogenated bisphenol A, and the like); an adduct of an AO with a carbon number of 2 to 4 of the aliphatic ring type diol (addition mole 2 to 30); an adduct of AO (addition mole 2 to 30) with a carbon number of 2 to 4 of bisphenols (bisphenol A, bisphenol F, and bisphenol S, and the like) may be used.

As the polyisocyanate component for the urethane extending capable of being used to form the first polyester resin, a general organic polyisocyanate component may be used.

For example, diphenylmethane diisocyanate, isophorone diisocyanate, xylylene diisocyanate, p-phenylene diisocyanate, toluene diisocyanate, naphthalene diisocyanate, dibenzyl dimethyl methane p, p'-diisocyanate, hexamethylene diisocyanate, norbornene diisocyanate, and the like, and an isocyanurate compound of these diisocyanate compounds, adduct of these diisocyanate compounds, may be used.

The toner for developing the electrostatic charge image of the present embodiment uses a mixture of two or more types of polyester resins having the above-described Characteristics (1) to (4), as the first polyester resin.

The toner for developing the electrostatic charge image of the present embodiment uses a crystalline polyester resin as well as the first polyester resin as the binder resin. In the present specification, the crystalline polyester resin is referred to as a second polyester resin.

In this embodiment, the crystalline polyester resin capable of being used as the binder resin has the following characteristics (A) to (E):

(A) an endothermic amount in the fusing found by differential scanning calorimetry (DSC) measurement is in the range of 2.0 to 10.0 W/g;

(B) the weight average molecular weight is in the range of 5,000 to 15,000;

(C) in an endothermic curve of the differential scanning calorimeter measurement, a difference between an endothermic start temperature and an endothermic peak temperature when the temperature is increased is in the range of 3 to 5° C.;

(D) one or more types of elements including at a least a sulfur element to be selected from a group consisting of the sulfur element and the fluorine element is included; and (E) the content having the weight average molecular weight 1,000 or less is in the range of from 1% to less than 10%.

The endothermic amount in the fusing of the crystalline polyester resin, as described above, may be in the range of 2.0 to 10 W/g, for example, 2.5 to 9.0 W/g. If the endothermic amount in the fusing is in the range of 2.0 to 10 W/g, the fusing of the toner for developing the electrostatic charge image may be promoted by a smaller heat amount. If the endothermic amount in the fusing exceeds 10 W/g, a larger heat amount for the fusion of the crystalline polyester resin is required. The crystalline polyester resin of which the endothermic amount in the fusing is less than 2.0 W/g has the low crystallinity.

The weight average molecular weight of the crystalline polyester resin, as described above, is in the range of 5,000 to 15,000. If the weight average molecular weight is less than 5,000, incompatibility with the amorphous polyester resin is generated such the lower preservability of the toner may be caused. If the weight average molecular weight is over 15,000, the toner low temperature fixability deterioration may be exacerbated.

The difference of the endothermic start temperature and the endothermic peak temperature while increasing the temperature of the crystalline polyester resin, as described above, is in the range of 3 to 5° C. When the difference of the endothermic start temperature and the endothermic peak temperature while increasing the temperature is less than 3° C., it is difficult to be synthesized while ensuring the composition of the resin. When the difference of the endothermic start temperature and the endothermic peak temperature while increasing the temperature is over 5° C., the toner preservability is deteriorated, and the maintenance of the fusing performance after toner long term storage may be difficult.

The crystalline polyester resin, as described above, as an element derived from the catalyst used for the synthesis under 100° C., includes one or more elements selected by including at least a sulfur element in the sulfur element and the fluorine element.

In the crystalline polyester resin, the content of the weight average molecular weight of 1,000 or less is in the range of 1 to 10%. If the content of the weight average molecular weight of 1,000 or less is more than 10%, toner heat stability deterioration and toner fusing lower limit performance deterioration after long term storage may occur. If the content of the weight average molecular weight 1,000 or less is less than 1%, the toner fusing low limit performance may be deteriorated.

The endothermic amount in the fusing of the crystalline polyester resin and the difference of the endothermic start temperature when increasing the temperature and the endothermic peak temperature may be controlled by controlling the type of the polycarboxylic acid component and the polyol component used as the monomer of the crystalline polyester resin or adjusting the combination ratio of the polycarboxylic acid component and the polyol component. Also, the weight average molecular weight of the crystalline polyester resin and the content of the weight average molecular weight of 1,000 or less may be controlled by controlling the reaction temperature, the time, and the like in the manufacturing.

The endothermic amount in the fusing of the crystalline polyester resin and the difference of the endothermic start temperature when increasing the temperature and the endothermic peak temperature, as described later, may be obtained from the differential scanning calorimetric curve obtained by the differential scanning calorimeter measurement. Also, the weight average molecular weight of the crystalline polyester resin and the content of the weight average molecular weight of 1,000 or less, as described later, may be obtained by gel permeation chromatography (GPC) measurement. In addition, the content of the sulfur element and the fluorine element in the crystalline polyester resin, as described later, may be measured by X-ray fluorescence analysis.

The crystalline polyester capable of being used as the resin binder resin may have a melting point in the range of 60 to 80° C., for example, 65 to 75° C. If the melting point is in the range of 60 to 80° C., the toner preservability and the fixability may be compatible. If the melting point exceeds 80° C., the toner fixability may deteriorate. If the melting point is less than 60° C., the preservability may deteriorate.

The melting point of the crystalline polyester resin may be controlled by controlling the type of the polycarboxylic acid component and the polyol component, used as the monomer, or adjusting the combination ratio of the polycarboxylic acid component and the polyol component.

The melting point of the crystalline polyester resin, as described later, may be obtained from the differential scanning calorimetry curve obtained by the differential scanning calorimeter measurement.

When using the crystalline polyester resin as the binder resin, the content of the crystalline polyester resin may be in the range of 5 to 20 wt % for the entire binder resin, for example, 7 to 15 wt %. When the content of the crystalline polyester resin is in the range of 5 to 20 wt %, the toner preservability and the fixability may be compatible. If the content of the crystalline polyester resin exceeds 20 wt %, the preservability may deteriorate and the electric characteristic may deteriorate. If the content of the crystalline polyester resin is less than 5 wt %, the fixability may deteriorate.

The crystalline polyester resin capable of being used as the binder resin may be synthesized by dehydration-condensing the polycarboxylic acid component and the polyol component.

As the polycarboxylic acid component capable of being used for the synthesis of the crystalline polyester resin, the aliphatic polycarboxylic acid may be used. As a specific example, an oxalic acid, a succinic acid, a glutaric acid, an adipic acid, a sebacic acid, a decanoic diacid, a dodecane diacid, and the like may be used.

As the polyol component capable of being used for the synthesis of the crystalline polyester resin, an aliphatic polyol may be used. As a specific example, ethylene glycol, 1,4-butanediol, 1.6-hexanediol, 1,8-octanediol, 1.9-noanediol, 1,10-decanediol, and the like, may be used.

The toner for developing the electrostatic charge image of the present embodiment includes a coating layer formed of the binder resin on an outer surface. The coating layer is formed of the first polyester resin having the above described Characteristics (1) to (4).

According to an example, the coating layer has the thickness of 0.2 to 1.0 μm. If the thickness is less than 0.2 μm, deteriorating of the toner heat storage stability may be caused. If the thickness is over 1.0 μm, the toner fusing low limit performance may be worse.

The thickness of the coating layer may be measured by observation with a transmission electron microscope.

The toner for developing the electrostatic charge image of the present embodiment includes three or more elements selected by including at least the iron element, the silicon element, and the sulfur element from a group including the iron element, the silicon element, the sulfur element, and the fluorine element. The content of the iron element is in the range of $1.0\times10^3$ to $1.0\times10^4$ ppm, the content of the silicon element is in the range of $1.0\times10^3$ to $8.0\times10^3$ ppm, and the content of the sulfur element is in the range of 500 to 3,000 ppm. When including the fluorine element, the content of the fluorine element is in the range of $1.0\times10^3$ to $1.0\times10^4$ ppm.

The iron element and the silicon element are components derived from a flocculant described later, the sulfur element is a component derived from the catalyst described later, and the fluorine element is a component derived from the catalyst described later. Accordingly, in the toner for developing the electrostatic charge image, the content of the iron element and the silicon element may be controlled by controlling the type and the amount of the used flocculant, the content of the sulfur element may be controlled by controlling the type and the amount of the used catalyst and flocculant, and the content of the fluorine element may be controlled by controlling the type and the amount of the used catalyst.

In the toner for developing the electrostatic charge image, the content of the iron element, as described above, is in the range of $1.0\times10^3$ to $1.0\times10^4$ ppm, for example, 1,000 to 5,000 ppm. If the content of the iron element is in the range of $1.0\times10^3$ to $1.0\times10^4$ ppm, it may be used as the toner for developing the electrostatic charge image. If the content of the iron element exceeds $1.0\times10^4$ ppm, the toner physically property is excessively increased. If the content of the iron element is less than $1.0\times10^3$ ppm, the toner structure formation is insufficient.

In the toner for developing the electrostatic charge image, the silicon element content, as described above, is in the range of $1.0\times10^3$ to $8.0\times10^3$ ppm, for example, $1.0\times10^3$ to $5.0\times10^3$ ppm, for example, 1,500 to 4,000 ppm. If the content of the silicon element is in the range of $1.0\times10^3$ to $8.0\times10^3$ ppm, it may be used as the toner for developing the electrostatic charge image. If the content of the silicon element exceeds $8.0\times10^3$ ppm, the toner physical property is excessively increased. If the content of the silicon element is less than $1.0\times10^3$ ppm, the toner structure formation is not sufficient.

In the toner for developing the electrostatic charge image, the content of the sulfur element, as described above, is in the range of 500 to 3,000 ppm, for example, 1,000 to 3,000 ppm. If the content of the sulfur element is in the range of 500 to 3,000 ppm, it may be used as the toner for developing the electrostatic charge image. If the content of the sulfur element exceeds the 3,000 ppm, the toner electrical characteristic may deteriorate. If the content of the sulfur element is less than 500 ppm, the formation of the toner structure may not be sufficient.

When the toner for developing the electrostatic charge image includes the fluorine element, the content of the fluorine element in the toner for developing the electrostatic charge image, as described above, is in the range of $1.0\times10^3$ to $1.0\times10^4$ ppm, for example, 5,000 to 8,000 ppm. If the content of the fluorine element is in the range of $1.0\times10^3$ to $1.0\times10^4$ ppm, it may be used as the toner for developing the electrostatic charge image. If the content of the fluorine element exceeds $1.0\times10^4$ ppm, the toner physical property may be excessively high. If the content of the fluorine element is less than $1.0\times10^3$ ppm, the toner physical property may deteriorate.

The content of each element in the toner for developing the electrostatic charge image, as described later, may be measured by X-ray fluorescence analysis.

The toner for developing the electrostatic charge image of the present embodiment includes the colorant.

As the colorant that may be used for the toner for developing the electrostatic charge image of the present embodiment, disclosed dyes and pigments may all be used, for example, carbon black, nigrosine dye, iron black, naphthol yellow S, hansa yellow (10G, 5G, G), cadmium yellow, yellow iron oxide, ocher, yellow chrome, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazine yellow lake, quinoline yellow lake, anthracene yellow BGL, isoindolinone yellow, bengala, red lead, light orange, cadmium red, cadmium mercury red, antimony vermilion, permanent red 4R, para red, paisei red, parachloro orthonitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermillion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, navy blue, dark blue, anthraquinone blue, fast violet B, methyl violet lake, cobalt violet, manganese violet, dioxane violet, anthraquinone violet, chrome green, zinc green, oxide chrome, viridian, emerald green, pigment green B, naphthol green B, green gold, acid green lake, malachite green lake, phthalocyanine green, anthraquinone green, titanium dioxide, zinc white, lithopone, and mixtures thereof.

The toner for developing the electrostatic charge image of the present embodiment may include a release agent, a charge control agent, and the like.

As the release agent of the toner for developing the electrostatic charge image of the present embodiment, for example, solid paraffin wax, microcrystalline wax, rice bran wax, fatty acid amide-based wax, fatty acid-based wax, aliphatic mono ketones, fatty acid metal salt-based wax, fatty acid ester-based wax, partial saponified fatty acid ester-based wax, silicon varnish, higher alcohol, carnauba wax, and the like, may be used. Also, a polyolefin such as low molecular weight polyethylene, polypropylene, and the like may be used.

As the charge control agent that may be used for the toner for developing the electrostatic charge image of the present embodiment, all known ones can be used, for example, nigrosine-based dye, triphenyl methane-based dye, chrome-containing metal complex dye, molybdenum acid chelate dye, rhodamine-based dye, alkoxy-based amine, quaternary ammonium salt (including fluorine-modified quaternary ammonium salt), alkyl amide, single or compound phosphorus, single or compound tungsten, a fluorine-based surfactant, a salicylic acid metal salt, and a salicylic acid derivative metal salt may be used. In detail, BONTRON 03 for the nigrosine-based dye, BONTRON P-51 for the quaternary ammonium salt, BONTRON S-34 for the metal-containing azo dye, E-82 for an oxynaphthoic acid-based metal complex, E-84 for a salicylic acid-based metal complex, E-89 for a phenolic condensate (ORIENT CHEMICAL INDUSTRIES CO., LTD. Manufacturing), TP-302 and TP-415 for quaternary ammonium salt molybdenum complexes (HODOGAYA CHEMICAL CO., LTD. Manufacturing), Copy Charge PSY VP2038 for the quaternary ammonium salt, Copy Blue PR for the triphenyl methane derivative, Copy Charge NEG VP2036 for the quaternary ammonium salt, Copy Charge NX VP434 (HOECHST AG manufacturing), LRA-901 and LR-147 for a boron complex (JAPAN CARLIT CO., LTD. Manufacturing), copper phthalocyanine, perylene, quinacridone, an azo-based pigment, and other polymer-based compound having the functional group such as a sulfonic acid group, a carboxyl group, or the quaternary ammonium salt, may be used.

In the toner for developing the electrostatic charge image of the present embodiment, the acid value may be in the range of 3 to 25 mgKOH/g, for example, 5 to 20 KOH/g. If the acid value is in the range of 3 to 25 mgKOH/g, the toner for developing the electrostatic charge image having an excellent charging property may be obtained. If the acid value exceeds 25 mgKOH/g, the charge amount may be excessively increased. If the acid value is less than 3 mgKOH/g, it may be difficult to be charged.

The acid value of the toner for developing the electrostatic charge image may be controlled by adjusting the binder resin acid value.

The acid value of the toner for developing the electrostatic charge image may be measured by a neutralization titration method, as described later.

In the toner for developing the electrostatic charge image of the present embodiment, a volume average particle size may be in the range of 3 to 9 μm, for example, 2.5 to 8.5 μm. If the volume average particle size is in the range of 3 to 9 μm, a dense image may be easily formed. If the volume average particle size exceeds 9 μm, the dense image is difficult to generate. If the volume average particle size is less than 3 μm, the treatment of the toner for developing the electrostatic charge image is difficult.

Also, in the toner for developing the electrostatic charge image of the present embodiment, a presence amount of the particle having the particle size of 3 μm or less as a number average particle size may be 3 number percent or less, for example, 2.5 number percent. If the presence amount of the particle having the particle size of 3 μm or less is 3 number percent or less, the toner for developing the electrostatic charge image having the uniform particle size may be obtained. If the presence amount of the particle having the particle size of 3 μm or less exceeds 3 number percent, the deviation of the particle size in the toner for developing the electrostatic charge image is increased.

Also, in the toner for developing the electrostatic charge image of the present embodiment, a ratio of the presence amount of the particle having the particle size of 3 μm or less for the presence amount of the particle having the particle size of 1 μm or less as the number average particle size may be in the range of 2.0 to 4.0, for example, 2.5 to 3.5. If the ratio of the presence amount of the particle having the particle size of 3 μm or less to the presence amount of the particle having the particle size of 1 μm or less is in the range of 2.0 to 4.0, the presence amount of the small-diameter particle of difficult handling may be reduced and the toner for developing the electrostatic charge image has a small deviation of the particle size. If the ratio of the presence amount of the particle having the particle size of 3 μm or less to the presence amount of the particle having the particle size of 1 μm or less exceeds 4.0, the deviation of the particle size is increased in the toner for developing the electrostatic charge image. If the ratio of the presence amount of the particle having the particle size of 3 μm or less to the presence amount of the particle having the particle size of 1 μm or less is less than 2.0, the presence amount of the small-diameter particle of difficult handling is increased.

The volume average particle size of the toner for developing the electrostatic charge image may be controlled by adjusting a toner manufacturing condition. Also, the presence amount of the particle having the particle size of 3 μm or less in the toner for developing the electrostatic charge image may be controlled by adjusting the toner manufacturing conditions. The ratio of the presence amount of the particle having the particle size of 3 μm or less for the presence amount of the particle having the particle size of 1 μm or less may be controlled by adjusting the toner manufacturing conditions.

The volume average particle size of the toner for developing the electrostatic charge image may be measured by a pore electrical resistance method, as described later. Also, the presence amount of the particle having the particle size of 3 μm or less of the toner for developing the electrostatic charge image may be measured by a pore electrical resistance method, as described later. In addition, the presence amount of the particle having the particle size of 1 μm or less of the toner for developing the electrostatic charge image may be measured by a dynamic light scattering method.

Manufacturing Method of the Toner for Developing the Electrostatic Charge Image

An example of a manufacturing method of toner for developing the electrostatic charge image involves an amorphous polyester-based resin synthesis process, an amorphous polyester-based resin latex formation process, a crystalline polyester resin synthesis process, a crystalline polyester resin latex formation process, a mixture solution formation process, a first aggregation particle formation process, a coated aggregation particle formation process, and a fusion unit process.

The processes are each described in detail below.

1. The Amorphous Polyester-Based Resin Synthesis Process

First, the amorphous polyester-based resin synthesis process is a process in which a first polycarboxylic acid component and a polyol component are dehydration-condensed at a temperature of 150° C. or less in the presence of the catalyst, wherein (i) the resin obtained by the dehydration condensation urethane-extends in the presence of the polyisocyanate component, then extends by the second polycarboxylic acid component, and the first polyester resin is synthesized, or (ii) the resin obtained by the dehydration condensation extends by the second polycarboxylic acid component, and then urethane-extends in the presence of polyisocyanate component to synthesis the first polyester resin.

In the amorphous polyester-based resin formation process, as a raw material used for the formation of the first polyester resin, the first polycarboxylic acid component, the second polycarboxylic acid component, the polyol component, and the polyisocyanate component are used.

As the first polycarboxylic acid component capable of being used to form the first polyester resin, having the substituent group corresponding to two carboxyl groups, as described above, the general organic polycarboxylic acid such as an aliphatic carboxylic acid, an aromatic carboxylic acid, an acid anhydride thereof, and a lower alkyl (with a carbon number 1 to 4) ester thereof may be used. The first polycarboxylic acid component may be a composition including only one type of compound or may be a mixture of two or more types of compounds. The usage amount of the first polycarboxylic acid component is appropriately determined by considering the above-described Characteristics (1) to (4) of the first polyester resin. In detail, the usage amount of the first polycarboxylic acid component may be in the range of 7 to 35 wt % for the entire raw material used for the formation of the first polyester resin, for example, 10 to 30 wt %. If the usage amount of the first polycarboxylic acid component is in the range of 7 to 35 wt %, the first polyester resin having the above-described Characteristics (1) to (4) may be synthesized. If the usage amount of the first polycarboxylic acid component exceeds 35 wt %, the control of the required acid value and molecular weight is difficult. If the usage amount of the first polycarboxylic acid component is less than 7 wt %, the ensuring of the required molecular weight is difficult.

As the second polycarboxylic acid component capable of being used to form the first polyester resin, as described above, the general organic polycarboxylic acid having the substituent group corresponding to three or more carboxyl groups may be used. The second polycarboxylic acid component may be one type of compound, or a mixture of two or more types of compounds. The usage amount of the second polycarboxylic acid component is appropriately determined by considering the above-described Characteristics (1) to (4) of the first polyester resin. In detail, the usage amount of the second polycarboxylic acid component is in the range of 0.8 to 7.0 wt % for the entire raw material used for formation of the first polyester resin, for example, 1.0 to 6.6 wt %. If the usage amount of the second polycarboxylic acid component is in the range of 0.8 to 7.0 wt %, the first polyester resin having the above-described Characteristics (1) to (4) may be synthesized. If the usage amount of the second polycarboxylic acid component exceeds 7.0 wt %, the charging amount is excessively high. If the usage amount of the second polycarboxylic acid component is less than 0.8 wt %, the charging amount is excessively low.

As the polyol component capable of being used to form the first polyester resin, as described above, the general polyol may be used. The polyol component may be one type of compound, or a mixture of two or more types of compounds. The usage amount of the polyol component may be appropriately determined by considering the above-described Characteristics (1) to (4) of the first polyester resin. In detail, the usage amount of the polyol component is in the range of 55 to 80 wt % for the entire raw material used for formation of the first polyester resin, for example, 58 to 75 wt %.

If the usage amount of the polyol component is in the range of 55 to 80 wt %, the first polyester resin having the above-described Characteristics (1) to (4) may be synthesized. If the usage amount of the polyol component exceeds 80 wt %, the ensuring of the required molecular weight is difficult. If the usage amount of the polyol component is less than 55 wt %, the control of the required acid value and molecular weight is difficult.

As the polyisocyanate component capable of being used to form the first polyester resin, as described above, the general organic polyisocyanate may be used. The polyisocyanate component may be one type of compound, or a mixture of two or more types of compounds. The usage amount of the polyisocyanate component is suitably determined by considering the above-described Characteristics (1) to (4) of the first polyester resin. In detail, the usage amount of the polyisocyanate component is in the range of 3 to 30 wt % for the entire raw material used for the formation of the first polyester resin, for example, 4 to 25 wt %. If the usage amount of the polyisocyanate component is in the range of 3 to 30 wt %, the first polyester resin having the above-described Characteristics (1) to (4) may be synthesized. If the usage amount of the polyisocyanate component exceeds 30 wt %, the charge amount is decreased. If the usage amount of the polyisocyanate component is less than 3 wt %, it is difficult to ensure the required molecular weight.

In the amorphous polyester-based resin formation process, the catalyst is used. The catalyst used for the formation of the first polyester resin includes one or more types of elements selected by including at least a sulfur element in a group consisting of the sulfur element and the fluorine element. The catalyst may be one compound or the mixture of two or more types of compounds. As the catalyst including one or more types of elements including at least a sulfur element selected from a group consisting of the sulfur element and the fluorine element, a strong acid compound may be used. For example, p-toluenesulfonic acid monohydrate, bis(1,1,2,2,3,3,4,4,4-nonafluoro-1-butanesulfonyl) imide, scandium (III) triflate, dodecylbenzenesulfonic acid, or sulfuric acid may be used. The usage amount of the catalyst is suitably determined by considering the above-described content range of the sulfur element and the fluorine element. The usage amount of the catalyst may be, for example, in a range of 0.1 to 2.0 wt % for the entire raw material used for the formation of the first polyester resin, for example, 0.2 to 1.0 wt %. If the usage amount of the catalyst is in a range of 0.1 to 2.0 wt %, the content of the sulfur element and the fluorine element may be in the above-described range. If the usage amount of the catalyst exceeds 2.0 wt %, the coloring of the resin may occur by the side effect progress. If the content of the catalyst is less than 0.1 wt %, it is difficult to ensure the molecular weight of the polyester resin.

The amorphous polyester-based resin synthesis process, for example, includes a first case in which the first esterification process, the urethane extending process, the second esterification process, and the recovery process are progressed, and a second case in which the first esterification process, the second esterification process, the urethane extending process, and the recovery process are performed.

Now, the amorphous polyester-based resin synthesis process will be described for each process with the first case and the second case.

[First Case]

<First Esterification Process>

In the first esterification process, firstly, the first polycarboxylic acid component, the polyol component, and the catalyst are put into a reaction container.

In the first esterification process, next, an inert gas atmosphere is formed within the reaction container, and the mixture of the first polycarboxylic acid component, the polyol component, and the catalyst is heated to be melted, thereby forming a mixture solution including the first polycarboxylic acid component, the polyol component, and the catalyst.

A heating temperature to heat the mixture is appropriately determined by considering the type and the amount of the first polycarboxylic acid component and the polyol component used as the monomer.

In the first esterification process, next, the temperature of the mixture solution is raised to a predetermined temperature of 150° C. or less. This temperature is the synthesis temperature of the polyester resin. Next, the inside of the reaction container is formed into a vacuum, and at the synthesis temperature of the polyester resin, the first polycarboxylic acid component and the polyol component are dehydration-condensation reacted for a predetermined time to form the polyester resin.

By adjusting the type of the monomer and the combination ratio and by adjusting the type of the catalyst, the synthesis temperature of the polyester resin may be lowered. The synthesis temperature of the polyester resin, as described above, is 150° C. or less, for example, 80 to 150° C. If the synthesis temperature is 150° C. or less, the energy consumption amount may be reduced in the polyester resin synthesis. If the synthesis temperature exceeds 150° C., because the energy consumption amount in the polyester resin synthesis is increased. If the synthesis temperature is less than 80° C., because the synthesis time of the polyester resin is long.

The synthesis time of the polyester resin is appropriately determined by considering the synthesis temperature, and the type and the combination ratio of the polycarboxylic acid component used and the polyol component as the monomer.

<Urethane Extending Process>

In the urethane extending process, firstly, after returning the reaction container to normal pressure, the polyisocyanate component and the organic solvent are added to the solution formed with the polyester resin.

The organic solvent is added to lower the viscosity of the mixture solution in the reaction container. As the organic solvent to be used in the urethane extending process, toluene, xylene, methyl ethyl ketone, methyl isobutyl ketone, or ethyl acetate may be used. The addition amount of the organic solvent is appropriately determined by considering the viscosity of the mixture solution in the reaction container.

In the urethane extending process, next, the inside of the reaction container is formed with the inert gas atmosphere, and at the predetermined temperature for the predetermined time, the polyester resin and the polyisocyanate component are reacted, thereby urethane-extending the polyester resin.

For the urethane extending of the polyester resin, the reaction temperature is appropriately determined by considering the reaction time required for ensuring the physical property. For example, the reaction temperature may be in a range of 60 to 100° C., or in a range of 80 to 100° C. If the reaction temperature is in a range of 60 to 100° C., the required physical property may be ensured while reducing the energy consumption. If the reaction temperature exceeds 100° C., the energy consumption amount is increased. If the reaction temperature is less than 60° C., the reaction time to ensure the required physical property is long.

The reaction time for the urethane extending of the polyester resin is appropriately determined by considering the reaction temperature, and the type and the combination ratio of the polycarboxylic acid component and the polyol component used as the monomer.

<Second Esterification Process>

In the second esterification process, firstly, the second polycarboxylic acid component is added to the solution formed with the urethane-extended polyester resin.

In the second esterification process, next, in the inert gas atmosphere, at the synthesis temperature of the polyester resin during the predetermined time, the second polycarboxylic acid component and the urethane-extended polyester resin are dehydration-condensation reacted to be extended by the second polycarboxylic acid component, thereby forming the first polyester resin.

<Recovery Process>

In the recovery process, the organic solvent used in the urethane extending process is removed from the solution formed with the first polyester resin to obtain the first polyester resin.

As the method for removing the organic solvent, an evaporating method may be used.

The obtained first polyester resin is the amorphous polyester-based resin and has the following Characteristics (1) to (4):

(1) the aromatic ring concentration is in a range of 4.5 to 5.8 mol/kg;

(2) the weight average molecular weight (MW) is in a range of 7,000 to 50,000;

(3) the glass transition temperature (Tg) is in a range of 50 to 70° C.; and (4) if the weight average molecular weight (MW) is in a range of 7,000 or more to less than 14,000, Equation 1 below is satisfied, and if the weight average molecular weight (MW) is in a range of 14,000 or more to 50,000, Equation 2 below is satisfied.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

[Second Case]

<First Esterification Process>

The first esterification process is performed like the first case.

<Second Esterification Process>

In the second esterification process, firstly, after returning the reaction container to normal pressure, the second polycarboxylic acid component is added in the solution formed with the polyester resin.

In the second esterification process, next, the inside of the reaction container is formed with the inert gas atmosphere, and at the synthesis temperature of the polyester resin for the predetermined time, the second polycarboxylic acid component and the polyester resin are dehydration-condensation reacted to be extend the polyester resin by the second polycarboxylic acid component.

<Urethane Extending Process>

In the urethane extending process, firstly, the polyisocyanate component and the organic solvent are added to the solution formed with the polyester resin extended by the second polycarboxylic acid component.

The organic solvent is added to lower the viscosity of the mixture solution in the reaction container. As the organic solvent to be used in the urethane extending process, toluene, xylene, methyl ethyl ketone, methyl isobutyl ketone, or ethyl acetate may be used. The addition amount of the organic solvent is appropriately determined by considering the viscosity of the mixture solution in the reaction container.

In the urethane extending process, next, in the inert gas atmosphere, and at the predetermined temperature for the predetermined time, the polyester resin extended by the second polycarboxylic acid component and the polyisocyanate component are reacted to be urethane-extended, thereby forming the first polyester resin.

The reaction temperature to urethane-extend the polyester resin extended by the second polycarboxylic acid component is appropriately determined by considering the reaction time required for ensuring the physical property. For example, the reaction temperature may be in a range of 60 to 100° C., for example, 80 to 100° C. If the reaction temperature is in a range of 60 to 100° C., the required physical property may be ensured while reducing the energy consumption. If the reaction temperature exceeds 100° C., the energy consumption amount is increased. If the reaction temperature is less than 60° C., the reaction time to ensure the required physical property is long.

The reaction time for urethane-extending the polyester resin extended by the second polycarboxylic acid component is appropriately determined by considering the reaction temperature, or the type and the combination ratio of the first polycarboxylic acid component, the second polycarboxylic acid component, and the polyol component used as the monomer.

<Recovery Process>

In the recovery process, the organic solvent used in the urethane extending process is removed from the solution formed with the first polyester resin to obtain the first polyester resin.

As the method for removing the organic solvent, the evaporating method may be used.

The obtained first polyester resin is the amorphous polyester-based resin and has the following Characteristics (1) to (4):

(1) the aromatic ring concentration is in a range of 4.5 to 5.8 mol/kg;

(2) the weight average molecular weight (MW) is in a range of 7,000 to 50,000;

(3) the glass transition temperature (Tg) is in a range of 50 to 70° C.; and (4) if the weight average molecular weight (MW) is in a range of 7,000 or more to less than 14,000, Equation 1 below is satisfied, and if the weight average molecular weight (MW) is in a range of 14,000 or more to 50,000 or less, Equation 2 below is satisfied.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

2. The Amorphous Polyester-Based Resin Latex Formation Process

The amorphous polyester-based resin latex formation process is a process of forming the first polyester resin latex including the first polyester resin as the amorphous polyester-based resin.

In the amorphous polyester-based resin latex formation process, firstly, the first polyester resin and the organic solvent are put in the reaction container, and the first polyester resin is dissolved in the organic solvent. As the first polyester resin having the above-described Characteristics (1) to (4), when using the mixture of two or more types of polyester resin, in this process, two or more types of polyester resins are put in the reaction container.

The content of the first polyester resin in the solution including the first polyester resin is suitably determined by considering the viscosity.

As the organic solvent to be used for the amorphous polyester-based resin latex formation process, methyl ethyl ketone, isopropyl alcohol, ethyl acetate, or a mixed solvent thereof may be used.

In the amorphous polyester-based resin latex formation process, next, while stirring the solution including the first polyester resin, the alkaline solution is slowly added, and water is additionally added at a predetermined speed to form a liquid emulsion.

The alkaline solution is added to neutralize the solution including the first polyester resin. As the alkaline solution to be used as the amorphous polyester-based resin latex formation process, an ammonia solution, consisting of an amine compound, may be used. The addition amount of the alkaline solution is appropriately determined by considering acidity of the solution including the first polyester resin.

The addition amount of the water is appropriately determined by considering the particle diameter of an obtained latex. The addition speed of the water is appropriately determined by considering the particle diameter distribution of the latex.

In the amorphous polyester-based resin latex formation process, next, the organic solvent is removed from the liquid emulsion until the solid first polyester resin reaches a predetermined concentration, and the first polyester resin latex including the first polyester resin is obtained.

The method for removing the organic solvent may use a reduced pressure distillation method.

The concentration of the first polyester resin in the first polyester resin latex is appropriately determined by considering the latex viscosity, the storage stability, the economic efficiency, and the like. For example, the concentration of the first polyester resin may be in a range of 10 to 50 wt %, for example, 20 to 40 wt %.

3. The Crystalline Polyester Resin Synthesis Process

The crystalline polyester resin synthesis process is a process of dehydration condensing the polycarboxylic acid component and the polyol component in the presence of the catalyst at a temperature of 100° C. or less to synthesize the crystalline polyester resin.

In the crystalline polyester resin synthesis process, firstly, the polycarboxylic acid component, the polyol component, and the catalyst are put in the reaction container, As the polycarboxylic acid component used for the synthesis of the second polyester resin, as described above, the aliphatic polycarboxylic acid may be used. As a specific example, adipic acid, sebacic acid, decane diacid, or dodecane diacid may be used. As the polyol component used for the synthesis of the second polyester resin, as described above, the aliphatic polyol may be used. As a specific example, 1,6-hexanediol, 1,8-octanediol, 1,9-noanediol, or 1,10-decanediol may be used.

The catalyst used for the synthesis of the second polyester resin is to include one or more types of elements including at least a sulfur element selected from a group consisting of the sulfur element and the fluorine element. The catalyst may be one type of compound, or two or more types of compounds. The catalyst may include one or more elements including at least a sulfur element in the sulfur element and the fluorine element, as described above, can be p-toluenesulfonic acid•monohydrate, dodecylbenzenesulfonic acid, bis(1,1,2,2,3,3,4,4,4-nona fluorine-1-butanesulfonyl) imide, or scandium (III) triflate.

In the crystalline polyester resin synthesis process, next, the inside of the reaction container is formed with the inert gas atmosphere, and the mixture of the polycarboxylic acid component, the polyol component, and the catalyst are heated to be dissolved, thereby forming the mixture solution including the polycarboxylic acid component, the polyol component, and the catalyst.

In the crystalline polyester resin synthesis process, next, the temperature of the mixture solution is increased to the predetermined temperature of 100° C. or less. This temperature is the synthesis temperature of the polyester resin. Subsequently, the inside of the reaction container is formed to a vacuum, and at the synthesis temperature of the polyester resin for the predetermined time, the polycarboxylic acid component and the polyol component are dehydration-condensation reacted to form the second polyester resin.

The obtained second polyester resin is the crystalline polyester resin and has the following characteristics (A) to (E):

(A) the endothermic amount in the fusing found by the differential scanning calorimetry is in a range of 2.0 to 10.0 W/g;

(B) the weight average molecular weight is in a range of 5,000 to 15,000;

(C) for the endothermic curve found in the differential scanning calorimetry, the difference between the endothermic start temperature and the endothermic peak temperature when increasing the temperature is in a range of 3 to 5° C.;

(D) one or more elements selected by including at least a sulfur element in the sulfur element and the fluorine element is included; and (E) the content of the weight average molecular weight of 1,000 or less is in a range of from 1% to less than 10%.

4. The Crystalline Polyester Resin Latex Formation Process

The crystalline polyester resin latex formation process is a process of forming the second polyester resin latex including the second polyester resin of the crystalline polyester resin.

In the crystalline polyester resin latex formation process, the second polyester resin and the organic solvent are firstly put in the reaction container, and the second polyester resin is dissolved in the organic solvent.

The content of the second polyester resin in the solution including the second polyester resin is appropriately determined by considering the latex viscosity, the storage stability, and the economic efficiency.

As the organic solvent that may be used for the crystalline polyester resin latex formation process, methyl ethyl ketone, isopropyl alcohol, ethyl acetate, and mixture solvents thereof may be used.

In the crystalline polyester resin latex formation process, next, while stirring the solution including the second polyester resin, the alkaline solution is slowly added, and the water is added at the predetermined speed to form the liquid emulsion.

The alkaline solution is added to neutralize the solution including the second polyester resin. As the alkaline solution that may be used for the crystalline polyester resin latex formation process, the aqueous ammonia or the amine compound may be used. The addition amount of the alkaline solution is appropriately determined by considering the acidity of the solution including the second polyester resin.

The addition amount of the water is appropriately determined by considering the particle diameter of the obtained latex. The addition speed of the water is appropriately determined by considering the particle diameter distribution of the latex.

In the crystalline polyester resin latex formation process, next, the organic solvent is removed from the liquid emulsion until the solid second polyester resin reaches the predetermined concentration, and the second polyester resin latex including the second polyester resin is obtained.

The method for removing the organic solvent may be the reduced pressure distillation method.

The concentration of the second polyester resin in the second polyester resin latex is appropriately determined by considering the latex viscosity, the storage stability, the economic efficiency, and the like. For example, the concentration of the second polyester resin may be in a range of 10 to 50 wt %, for example, 20 to 40 wt %.

5. The Mixture Solution Formation Process

The mixture solution formation process is a process of forming the mixture solution by mixing the first polyester resin latex, the second polyester resin latex, and the colorant dispersion solution including the colorant if necessary, the dispersion solution including the release agent if necessary.

The mixture solution formation process undergoes mixing process including the colorant dispersion solution formation process if necessary, and the release agent dispersion solution formation process if necessary.

Next, the mixture solution formation process will be described for each process.

<The colorant dispersion solution formation Process>

In the colorant dispersion solution formation process, firstly, the colorant, an anionic surfactant, and a dispersion media are put in the reaction container.

As the colorant that may be used for the toner for developing the electrostatic charge image of the present embodiment, the disclosed dyes and pigments may all be used, for example, carbon black, nigrosine dye, iron black, naphthol yellow S, hansa yellow (10G, 5G, G), cadmium yellow, yellow iron oxide, ocher, yellow chrome, titanium yellow, polyazo yellow, oil yellow, hansa yellow (GR, A, RN, R), pigment yellow L, benzidine yellow (G, GR), permanent yellow (NCG), vulcan fast yellow (5G, R), tartrazine yellow lake, quinoline yellow lake, anthracene yellow BGL, isoindolinone yellow, bengala, red lead, light orange, cadmium red, cadmium mercury red, antimony vermilion, permanent red 4R, para red, paisei red, parachloro orthonitroaniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubine GX, permanent red F5R, brilliant carmine 6B, pigment scarlet 3B, bordeaux 5B, toluidine maroon, permanent bordeaux F2K, helio bordeaux BL, bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermillion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indanthrene blue (RS, BC), indigo, navy blue, dark blue, anthraquinone blue, fast violet B, methyl violet lake, cobalt violet, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc white, lithopone, and mixtures thereof may be used. The content of the colorant in the mixture of the colorant, the anionic surfactant, and the dispersion media are appropriately determined by considering the dispersion state, and the like.

As the anionic surfactant used in the colorant dispersion solution formation process, alkylbenzene sulfonate, and the like, may be used. The content of the anionic surfactant in the mixture of the colorant, the anionic surfactant, and the dispersion media is appropriately determined by considering the dispersion state, and the like.

Glass beads may be used as the dispersion media in the colorant dispersion solution formation process. The content of the dispersion media in the mixture of the colorant, the anionic surfactant, and the dispersion media are appropriately determined by considering the dispersion state, the dispersion time, and the like, of the colorant.

In the colorant dispersion solution formation process, next, the mixture of the colorant, the anionic surfactant, and the dispersion media is processed to be dispersed to obtain the colorant dispersion solution.

As the method for processing-dispersing the mixture, a method using a milling bath, a method using a ultrasonic wave dispersing machine and a method using a microfluidizer may be used.

<The Release Agent Dispersion Solution Formation Process>

In the release agent dispersion solution formation process, firstly, the release agent, the anionic surfactant, and the water are put in the reaction container.

As the release agent that may be used for the toner for developing the electrostatic charge image of the present embodiment, solid paraffin wax, microcrystalline wax, rice bran wax, fatty acid amide-based wax, fatty acid-based wax, aliphatic mono ketones, fatty acid metal salt-based wax, fatty acid ester-based wax, partially saponified fatty acid ester-based wax, silicon varnish, higher alcohol, carnauba wax, and the like, may be used. Also, the polyolefin such as the low molecular weight polyethylene, polypropylene, and the like may be used. The content of the release agent in the mixture of the release agent the anionic surfactant and water is appropriately determined by considering the dispersion state.

Alkylbenzene sulfonate may be used as the anionic surfactant for the release agent dispersion solution formation process. The content of the anionic interface surfactant in the mixture of the release agent, the anionic surfactant, and the water is appropriately determined by considering the dispersion state, and the like.

The content of the water in the mixture of the release agent, the anionic interface surfactant, and the water is appropriately determined by considering the dispersion state, the stability, and the economic efficiency.

In the release agent dispersion solution formation process, next, the mixture of the release agent, the anionic surfactant, and the water is processed to be dispersed to obtain the release agent dispersion solution.

As a method of processing the mixture to be dispersed, a method using a homogenizer may be used.

<The Mixture Process>

In the mixture process, firstly, the first polyester resin latex, the second polyester resin latex, and the water are put in the reaction container. Next, while stirring the mixture of the first polyester resin latex, the second polyester resin latex, and the water, the colorant dispersion solution if necessary and the release agent dispersion solution if necessary are added to the mixture to form the mixture solution including the first polyester resin latex, the second polyester resin latex, the colorant dispersion solution including the colorant if necessary, and the release agent dispersion solution if necessary.

The input amount of the first polyester resin latex is appropriately determined by considering the toner physical properties, and the like.

The input amount of the second polyester resin latex is appropriately determined by considering the toner physical properties, and the like.

The input amount of the water is appropriately determined by considering the viscosity, the economic efficiency, and the like, of the mixture.

The input amount of the colorant dispersion solution is appropriately determined by considering a toner tinting strength, and the like.

The input amount of the release agent dispersion solution is appropriately determined by considering the toner physical property, and the like.

6. The First Aggregation Particle Formation Process

The first aggregation particle formation process is a process of adding the flocculant to the mixture solution and aggregating the first polyester resin, the second polyester resin, the colorant if necessary, and the release agent if necessary to form the first aggregation particle.

In the first aggregation particle formation process, firstly, while stirring the mixture solution including the first polyester resin latex, the second polyester resin latex, the water, the colorant dispersion solution if necessary, and the release agent dispersion solution if necessary, in the mixture solution, the flocculant and the acidic solution are added.

As the flocculant used for the first aggregation particle formation process, the iron element and the silicon element may be included. As the flocculant including the iron element and the silicon element, an iron-based metal salt may be used. In detail, a polysilicate iron or a polyaluminum chloride may be used.

The addition amount of the flocculant is appropriately determined by considering a range of the above-described content of the iron element and the sulfur element. For example, the addition amount of the flocculant is in a range of 0.5 to 3.0 wt % for the entire raw material used for the formation of the first polyester resin, or in a range of 1.0 to 2.5 wt %. If the addition amount of the flocculant is in a range of 0.5 to 3.0 wt %, the content of the iron element and the sulfur element may be within the above-described range. If the addition amount of the flocculant exceeds 3.0 wt %, the toner physical properties are excessively increased. If the addition amount of the flocculant is less than 0.5 wt %, the toner structure formation is not sufficient.

The acidic solution causes the mixture solution to be acidic and is added to promote the aggregation reaction. As the acidic solution used for the first aggregation particle formation process, a nitric acid solution or a hydrochloric acid solution may be used. The addition amount of the acidic solution is appropriately determined by considering the alkalinity, and the like, of the mixture solution.

In the first aggregation particle formation process, next, while processing the solution after adding the flocculant and the acidic solution to be dispersed, the temperature of the solution is increased to the predetermined temperature by a predetermined the increasing speed. In this case, the first polyester resin, the second polyester resin, if necessary the colorant, and if necessary the release agent are aggregation-reacted such that the first aggregation particle of the predetermined volume average particle size is formed, and the first aggregation particle dispersion solution including the first aggregation particle is obtained.

The volume average particle size of the obtained first aggregation particle may be controlled by adjusting the stirring speed in the dispersion process, the increasing speed of the solution temperature, the aggregation reaction time, and the like. The volume average particle size of the first aggregation particle is appropriately determined by considering the toner particle diameter, and the like. In detail, the volume average particle size of the first aggregation particle is in a range of 2.5 to 8.5 μm, for example, 3.0 to 4.5 μm.

After adding the flocculant and the acidic solution, the temperature increasing speed of the solution is appropriately determined by considering the first aggregation particle diameter, and the like.

As the solution dispersion process method after the addition of the flocculant and the acidic solution, the method of using the homogenizer may be applied.

7. The Coated Aggregation Particle Formation Process

The coated aggregation particle formation process is a process providing the coating layer formed of the first polyester resin on the surface of the first aggregation particle to form the aggregation particle coating.

In the coated aggregation particle formation process, firstly, while dispersion-processing the first aggregation particle dispersion solution including the first aggregation particle, the first polyester resin latex is added to the dispersion solution, and during the predetermined time, by aggregating the first aggregation particle and the first polyester resin, the coating layer formed of the first polyester resin is provided on the surface of the first aggregation particle. Accordingly, the coated aggregation particle dispersion solution including the coated aggregation particle with the coating layer on the outer surface may be obtained.

The addition amount of the first polyester resin latex is appropriately determined by considering the toner physical properties, and the like.

The aggregation reaction time is appropriately determined by considering the toner particle diameter, and the like.

As the method dispersion-processing the first aggregation particle dispersion solution, the method using the homogenizer may be applied.

In the coated aggregation particle formation process, next, the alkaline solution is added to the coated aggregation particle dispersion solution and pH is adjusted to stop the aggregation.

As the alkaline solution to stop the aggregation, an aqueous sodium hydroxide solution or potassium hydroxide solution may be used. The addition amount of the alkaline solution is appropriately determined by considering the acidity of the coated aggregation particle dispersion solution.

8. The Fusion Unity Process

The fusion unity process is a process of fusion-uniting the coated aggregation particle at a temperature higher than the glass transition temperature of the first polyester-based resin.

In the fusion unity process, the particle in the coated aggregation particle is fusion-united by the processing during the predetermined time at a temperature higher than the glass transition temperature of the first polyester-based resin. Accordingly, the toner particle of the predetermined volume average particle size with the coating layer on the outer surface is formed and the toner particle dispersion solution including the toner particle is obtained.

The fusion reaction temperature is appropriately determined by considering the toner physical properties, the shape, the economic efficiency, and the like. The fusion reaction time is appropriately determined by considering the toner shape, and the like.

After the fusion unity process, the toner particle is separated from the toner particle dispersion solution.

As a method for separating the toner particle from the toner particle dispersion solution, a filtering method may be used.

The obtained toner particle has the following Characteristics (1) to (6):

(1) three or more elements selected by including at least the iron element, the silicon element, and the sulfur element from the group including the iron element, the silicon element, the sulfur element, and the fluorine element are included;

(2) the content of the iron element is in a range of $1.0\times10^3$ to $1.0\times10^4$ ppm, the content of the silicon element is in a range of $1.0\times10^3$ to $8.0\times10^3$ ppm, and the content of the sulfur element is in a range of 500 to 3,000 ppm, and when including the fluorine element, the content of the fluorine element is in the range of $1.0\times10^3$ to $1.0\times10^4$ ppm;

(3) the acid value is in the range of 3 to 25 mgKOH/g;

(4) the volume average particle size is in a range of 3 to 9 μm;

(5) the presence amount of the particle having the particle size of 3 μm or less as the number average particle size is in the range of 3 number percent or less; and (6) the ratio of the presence amount of the particle having the particle size of 3 μm or less to the presence amount of the particle having the particle size of 1 μm or less is in a range of 2.0 to 4.0.

C. The Effect

According to the toner for developing the electrostatic charge image of the present embodiment, three or more elements selected by including at least the iron element, the silicon element, and the sulfur element from the group including the iron element, the silicon element, the sulfur element, and the fluorine element are included, the content of the iron element is in a range of $1.0\times10^3$ to $1.0\times10^4$ ppm, the content of the silicon element is in a range of $1.0\times10^3$ to $8.0\times10^3$ ppm, and the content of the sulfur element is in a range of 500 to 3,000 ppm, when including the fluorine element, the content of the fluorine element is in a range of $1.0\times10^3$ to $1.0\times10^4$ ppm, the binder resin comprises at least the amorphous polyester-based resin wherein (1) the aromatic ring concentration is in a range of 4.5 to 5.8 mol/kg, (2) the weight average molecular weight (MW) is in a range of 7,000 to 50,000, (3) the glass transition temperature (Tg) is in a range of 50 to 70° C., and (4) if a weight average molecular weight (MW) is in a range from 7,000 or more to less than 14,000, Equation 1 is satisfied and if a weight average molecular weight (MW) is in a range from 14,000 or more to 50,000 or less, Equation 2 is satisfied.

Accordingly, the toner for developing the electrostatic charge image of which the low temperature fixability and the preservability are excellent and the energy consumption amount is reduced in the toner manufacturing may be obtained.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

Also, the manufacturing method of the toner for developing the electrostatic charge image of the present embodiment includes: the amorphous polyester-based resin synthesis process in which the first polycarboxylic acid component and the polyol component are dehydration-condensed at a temperature of 150° C. or less in the presence of the catalyst, wherein (i) the resin obtained by the dehydration condensation urethane-extends in the presence of the polyisocyanate component, then extends by the second polycarboxylic acid component having the substituent group corresponding to three or more carboxyl groups, and the first polyester resin is synthesized, or (ii) the resin obtained by the dehydration condensation extends by the second polycarboxylic acid component having the substituent group corresponding to three or more carboxyl groups, then urethane-extends in the presence of the polyisocyanate component, such that the amorphous polyester-based resin is synthesized; the amorphous polyester-based resin latex formation process forming the latex of the amorphous polyester-based resin; the crystalline polyester resin synthesis process in which the aliphatic polycarboxylic acid component and the aliphatic polyol component are dehydration-condensed at a temperature of 100° C. or less in the presence of the catalyst, and the crystalline polyester resin is synthesized; the crystalline polyester resin latex formation process forming the latex of the crystalline polyester resin; the mixture solution formation process of mixing at least amorphous polyester-based resin latex and the crystalline polyester resin latex to form the mixture solution; the first aggregation particle formation process in which the amorphous polyester-based resin and the crystalline polyester resin are aggregated by adding the flocculant to the mixture solution to form the first aggregation particle; the coated aggregation particle formation process providing the coating layer formed of the amorphous polyester-based resin on the surface of the first aggregation particle to form the aggregation particle coating; and the fusion unity process fusion-uniting the coated aggregation particle at a temperature higher than the glass transition temperature of the amorphous polyester-based resin, wherein for the amorphous polyester-based resin, (1) the aromatic ring concentration is in a range of 4.5 to 5.8 mol/kg, (2) the weight average molecular weight (MW) is in a range of 7,000 to 50,000, (3) the glass transition temperature (Tg) is in a range of 50 to 70° C., (4) Equation 1 is satisfied if the weight average molecular weight (MW) is in a range from 7,000 or more to less than 14,000, Equation 2 is satisfied if the weight average molecular weight (MW) is in a range from 14,000 or more to 50,000 or less, and for the crystalline polyester resin, (A) the endothermic amount in the fusing by the differential scanning calorimetry is in a range of 2.0 to 10.0 W/g, (B) the weight average molecular weight is in a range of 5,000 to 15,000, (C) for the endothermic curve in the differential scanning calorimetry, the difference of the endothermic start temperature and the endothermic peak temperature while increasing the temperature is in a range of 3 to 5° C., (D) one or more types of elements including at least a sulfur element selected from a group consisting of the sulfur element and the fluorine element, (E) the content of the weight average molecular weight of 1,000 or less is in a range of form 1% to less than 10%, the catalyst includes one or more types of elements selected by including at least a sulfur element in the sulfur element and the fluorine element, and the flocculant includes the iron element and the silicon element.

Accordingly, the toner for developing the electrostatic charge image of which the low temperature fixability and the preservability are excellent and the energy consumption amount is reduced in the toner manufacturing may be obtained.

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

Embodiment

Next, an embodiment according to the present description and a comparative example are described in detail. Herein, the following embodiment is simply an example, and the present description is not limited thereto.

Firstly, before describing the embodiment and the comparative example, various measurement and estimating methods will be described.

<The Aromatic Ring Concentration>

The aromatic ring concentration of the polyester resin is obtained by analyzing an ultraviolet ray absorption spectrum. In detail, with a light transmittance visible-ultraviolet spectrophotometer U-3410 manufactured by HITACHI LTD., an ultraviolet ray spectrum in a wavelength range of 220 to 340 nm is measured. Two points that represent a minimum strength and are located in the vicinity of 230 nm and 310 nm are connected as a base line. A line vertical to the base line is drawn downwardly from a maximum absorbance in the vicinity of 240 to 300 nm, and the absorbance is obtained from a length of the vertical line. The aromatic ring concentration is calculated from the absorbance obtained by using a calibration curve prepared by using a phenol of a known concentration.

<The Weight Average Molecular Weight> and <the Content of Weight Average Molecular Weight of 1,000 or Less>

The weight average molecular weight and the content of the weight average molecular weight of 1,000 or less are obtained by gel permeation chromatography (GPC) measurement. In detail, WATERS e2695 (manufactured by JAPAN WATERS CO., LTD.) equipment is used as a measuring device, and INERTSIL CN-325 cm 2 series (manufactured by GL SCIENCES INC.) equipment is used for a column. Also, a filtrate of which polyester resin at 30 mg is added to tetrahydrofuran (THF) (containing the stabilizer, manufactured by WAKO PURE CHEMICAL INDUSTRIES, LTD.) at 20 mL and is stirred for 1 h and then is filtered by a 0.2 μm filter is used as a sample. The tetrahydrofuran (THF) sample solution is inserted to the measuring device at 20 μL and is measured in a condition of a temperature of 40° C. and a flow rate of 1.0 mL/min.

<The Glass Transition Temperature>

The glass transition temperature (° C.) of the polyester resin is obtained from a differential scanning calorimetry curve obtained by differential scanning calorimeter measurement specified in ASTM D3418-08. In detail, by using a differential scanning calorimeter Q2000 (manufactured by TA INSTRUMENTS, INC.) in a first temperature increasing process, the temperature is increased from room temperature to 150° C. at a speed of 10° C. per min, and after being maintained for 5 min at 150° C., the temperature is decreased to 0° C. at a speed of 10° C. per min by using liquid nitrogen.

After being maintained for 5 min at 0° C., as a second temperature increasing process, the temperature is increased from 0° C. to 150° C. at a speed of 10° C. per min, and the glass transition temperature is determined from the obtained differential scanning calorimetry curve.

<The Endothermic Amount of the Crystalline Polyester Resin in the Fusing> and <the Difference of the Endothermic Start Temperature and the Endothermic Peak Temperature while Increasing the Temperature>

The endothermic amount of the crystalline polyester resin in the fusing and the difference (° C.) of the endothermic start temperature and the endothermic peak temperature while increasing the temperature is calculated from the differential scanning calorimetry curve obtained by a differential scanning calorimeter measurement (DSC) specified in ASTM D3418-08. In detail, the differential scanning calorimeter Q2000 (manufactured by TA INSTRUMENTS, INC.) is used, and as a first temperature increasing process, the temperature is increased from room temperature to 150° C. at a speed of 10° C. per min, and after being maintained for 5 min at 150° C., by using the liquid nitrogen, the temperature is decreased to 0° C. at a speed of 10° C. per min. After being maintained for 5 min at 0° C., as a second temperature increasing process, the temperature is increased from 0° C. to 150° C. at a speed of 10° C. per min, and the endothermic amount of the crystalline polyester resin in the fusing and the difference of the endothermic start temperature and the endothermic peak temperature while increasing the temperature are calculated from the obtained differential scanning calorimetry curve.

<The Element Content>

The contents of the iron element, the silicon element, the sulfur element, and the fluorine element are obtained by X-ray fluorescence analysis. In detail, an X-ray fluorescence analysis device EDX-720 (manufactured by SHIMADZU Co., Ltd.) is used, and a condition of an X-ray tube voltage of 50 kV and a sample formation amount of 30.0 g is applied. The content of each element is obtained by using intensity (cps/μA) as a quantified result derived by the fluorescent X-ray measurement.

<The Acid Value>

The acid value (mgKOH/g) is obtained depending on a neutralization titration method of an acid value measurement method specified in JIS K 0070-1992 "A test method of an acid value, a saponification value, an ester value, an iodine value, and a hydroxyl group value of Chemical products, a saponified material".

<The Volume Average Particle Size>

The volume average particle size is measured by a crafted electrical resistance method. In detail, a COULTER COUNTER (manufactured by BECKMAN COULTER, INC.) is used as the measuring device, ISOTON II (manufactured by BECKMAN COULTER, INC.) is used as the electrolyte solution, a pore tube of a pore diameter of 100 μm is used, and a condition of a measuring particle number of 30,000 is applied. Based on the particle size distribution of the measured particle, the volume occupied by the particle that is included in the divided particle size range is accumulated from a small diameter side, and the particle diameter that becomes the accumulation of 50% is determined as a volume average particle size Dv50.

<The Presence Amount of the Particle Having the Particle Size of 3 μm or Less>

The presence amount of the particle having the particle size of 3 μm or less is measured by the crafted electrical resistance method. In detail, a COULTER COUNTER (manufactured by BECKMAN COULTER, INC.) is used as the measuring device, ISOTON II (manufactured by BECKMAN COULTER, INC.) is used as the electrolyte solution, a pore tube of a pore diameter of 100 μm is used, and a condition of a measuring particle number of 30,000 is applied. Based on the particle size distribution of the measured particle, the number percent of the particles having the particle size 3 μm or less is determined as the presence amount of the particles having the particle size of 3 μm or less.

<The Presence Amount of the Particles Having the Particle Size of 1 μm or Less>

The presence amount of the particles having the particle size of 1 μm or less is measured by the dynamic light scattering method. In detail, a Nano track particle diameter distribution measurement device (manufactured by NIKKISO CO., LTD.) is used as the measuring device. Based on the particle size distribution of the measured particle, the number percent of the particles having the particle size of 1 μm or less is determined as the presence amount of the particles having the particle size of 1 μm or less.

<The Fixability Estimation >

A belt-type fuser (a fuser of a COLOR LASER 660 model (product name) manufactured by SAMSUNG ELECTRONICS CO., LTD.) is used, a test non-fusing image of a 100% solid pattern is fused to a test paper of a 60 g paper (X-9 (product name) manufactured by BOISE CO.) in the condition of a fusing speed of 160 mm/s and a fusing time of 0.08 s. The fusing of the test non-fusing image is performed in each temperature at an interval of 5° C. in a range from 100° C. to 180° C.

An initial optical density (OD) of the fused image is measured. Next, a 3M 810 tape is adhered to an image part, and after a weight of 500 g reciprocates 5 times, the tape is removed. The optical density (OD) is measured after the tape removal.

A lowest temperature at which a fixability (%) required by Equation below becomes 90% or more is determined as the fixing temperature.

The fixability (%)=(the initial optical density/the optical density after the tape removal)×100

<The Preservability Estimation>

After the toner at 100 g is inserted in a mixer (KM-LS2K (product name) manufactured by DAEWHA TECH CO., LTD.), other additives of NX-90 (manufactured by JAPAN AEROSIL CO., LTD.) at 0.5 g, RX-200 (manufactured by JAPAN AEROSIL CO., LTD.) at 1.0 g, and SW-100 (manufactured by TITANIUM INDUSTRY CO., LTD.)) at 0.5 g are added. Next, by stirring at a stirring speed of 8000 rpm for 4 min, the other additives are adhered to the toner particle. Next, the toner adhered with the other additives is inserted into a developer (the developer of a COLOR LASER 660 model (product name) manufactured by SAMSUNG ELECTRONICS CO., LTD.), by using a constant temperature and humidity oven, is kept in the environment of a temperature of 23° C. and relative humidity of 55% (normal temperature and normal humidity) for 2 h, and then is kept in the environment of a temperature of 40° C. and relative humidity of 90% (high temperature and high humidity) for 48 h.

After maintaining these conditions, the presence or absence of caking of the toner in the developer is observed by the naked eye, and when the 100% solid pattern is output, the output image is evaluated by the naked eye to estimate the preservability as follows.

○: image good, caking NO

Δ: image poor, caking NO x: caking generation

<The Charging Property Estimation>

The magnetic material carrier (model SY129 (product name) manufactured by KDK company) at 28.5 g and the toner at 1.5 g are put in a 60 mL glass container.

Next, stirring is performed by using a Turbula mixer in the environment of the temperature of 23° C. and the relative humidity of 55% (room temperature and normal humidity). By measuring the charging amount of the toner by an electric field separation method every predetermined stirring time, a charge saturation curve representing the relationship between the stirring time and the charging amount of the toner is provided, and the charging property is estimated as follows.

○: the charge saturation curve is smooth such that a fluctuation range thereof is small after the saturation charging Δ: the charge saturation curve jumps a little, or the fluctuation range is generated slightly (up to 30%) after the saturation charging x: the charging is not saturated, or the fluctuation range is large (30% or more) after the saturation charging Next, Manufacturing Examples 1-17 of the amorphous polyester-based resin latex including the amorphous polyester-based resin used in the embodiment and Comparative Manufacturing Examples 1-13 of the amorphous polyester-based resin latex including the amorphous polyester-based resin used as a comparative example will be described.

Manufacturing Example 1

<The First Esterification Process>

Into a 500 mL separable flask equipped with a reflux condenser, a water removal apparatus, a nitrogen gas inlet tube, and a temperature-based stirrer, 291.3 g of propylene oxide 2 mol adduct of bisphenol A (ADEKA polyether BPX-11 (product name)) manufactured by ADEKA company) as a polyol component Y, 67.1 g of maleic anhydride (Manufactured by TOKYO CHEMICAL INDUSTRIES CO.) as the first polycarboxylic acid component X1, and 2.7 g of para-toluenesulfonic acid •monohydrate (PTSA, manufactured by WAKO PURE CHEMICAL INDUSTRIES, LTD.) as the catalyst, are added. Next, nitrogen is introduced into the flask, and while stirring the inside of the flask with the stirrer, the mixture of the propylene oxide at 2 mol addition of bisphenol A, the maleic anhydride and the para-toluenesulfonic acid •monohydrate is heated to 70° C. to be dissolved. While stirring the inside of the flask, the temperature of the mixture solution in the flask is increased to 97° C. Next, the inside of the flask is placed under vacuum (10 mPa's or less), and while stirring the inside of the flask at a temperature of 97° C. for 45 h, the dehydration condensation reaction of the maleic anhydride and the propylene oxide 2 mol adduct of bisphenol A is performed and the polyester resin is formed.

<The Urethane Extending Process>

After returning the inside of the flask to atmospheric pressure, in the flask, 27.9 g of diphenylmethane diisocyanate (MDI, WAKO PURE CHEMICAL INDUSTRIES, LTD.) as a polyisocyanate component, and 40 g of toluene (WAKO PURE CHEMICAL INDUSTRIES, LTD.) as the solvent are added. Next, nitrogen is introduced inside the flask, and while stirring the inside of the flask at the synthesis temperature of 97° C. until non-reacted diphenylmethane diisocyanate disappears, the polyester resin obtained from the first esterification process and the diphenylmethane diisocyanate are reacted and the urethane-extended polyester resin is formed. The disappearance of the non-reacted diphenylmethane diisocyanate is confirmed by measuring solution partially obtained from the flask by the infrared spectrophotometer, and confirming the disappearance of the peak derived from isocyanate near 2275 $cm^{-1}$.

<The Second Esterification Process>

After the urethane-extended polyester resin is formed, in the flask, pyromellitic dianhydride (TOKYO CHEMICAL INDUSTRIES CO. manufacturing) at 10.9 g as the second polycarboxylic acid component X2 is added to the flask. Next, nitrogen is introduced into the flask, and while stirring the inside of the flask at the synthesis temperature of 97° C. for 30 h, the dehydration condensation reaction of the pyromellitic anhydride and the urethane-extended polyester resin is performed, and the polyester resin including the structural unit represented by the above-described Chemical Formula 2 is obtained.

<The Recovery Process>

By evaporating toluene from the solution formed with the polyester resin obtained in the second esterification process, the amorphous polyester-based resin P1 is obtained.

For the obtained amorphous polyester-based resin P1, the aromatic ring concentration is 4.6 mol/kg, the content of the structural unit represented by Formula 2 is 0.12 mol/kg, the weight average molecular weight is 16,000, the glass transition temperature is 57° C., and the acid value is 14 mgKOH/g.

<The Latex Formation Process (Emulsion Process)>

Amorphous polyester-based resin P1 at 300 g, methyl ethyl ketone (MEK) at 250 g, and isopropyl alcohol (IPA) at 50 g are put in a 3 L double jacket reaction container. Next, in an environment of about 30° C., while stirring the inside of the reaction container by using a half-moon-shaped impeller, the amorphous polyester-based resin P1 is dissolved in the mixture solvent of methyl ethyl ketone and isopropyl alcohol. While stirring the inside of the reaction container, 26 g of the 5% aqueous ammonia solution is slowly and continuously added into the reaction container, and 1,200 g of the ion exchanged water is added at a 20 g/min speed to form the liquid emulsion. Next, until the concentration of the solid amorphous polyester-based resin P1 reaches 20 wt %, the mixture solvent of methyl ethyl ketone and isopropyl alcohol is removed from the liquid emulsion by a vacuum distillation method, and the amorphous polyester-based resin latex L1 is obtained.

Manufacturing Examples 2-14

Manufacturing Examples 2-14, except for changing the manufacturing conditions as shown in Table 1, are the same as Manufacturing example 1, the amorphous polyester-based resins (P2-P14) are synthesized, and the amorphous polyester-based resin latex (L2-L14) including the amorphous polyester-based resin (P2-P14) are obtained.

However, in Manufacturing Examples 12 and 13, after adding the first polycarboxylic acid component X1, the synthesis time is 2 h. Also, in the Manufacturing Example 14, after the first esterification process, the second esterification process is performed by adding the second polycarboxylic acid component X2, then the urethane extending process and the recovery process are performed.

The manufacturing conditions and the physical properties of the amorphous polyester-based resins P1-P14 obtained by Manufacturing Examples 1-14 are shown in Table 1. Also, the manufacturing conditions of the amorphous polyester-based resin latex L1-L14 including the amorphous polyester-based resins P1-P14 are shown in Table 1.

TABLE 1

| | | | | | manufacturing example 1 | manufacturing example 2 | manufacturing example 3 | manufacturing example 4 | manufacturing example 5 | manufacturing example 6 | manufacturing example 7 | manufacturing example 8 |
|---|---|---|---|---|---|---|---|---|---|---|---|---|
| | | resin latex (L) | | | L1 | L2 | L3 | L4 | L5 | L6 | L7 | L8 |
| polyester resin | | polyester resin (A1) | | | P1 | P2 | P3 | P4 | P5 | P6 | P7 | P8 |
| (A1) | carboxylic | (X1) | maleic acid anhydride | g | 67.1 | 58.6 | 31.1 | 39.7 | | 31.2 | 66.2 | 66.7 |
| synthesis | acid | | succinic acid anhydride | | | 7.0 | | | 66.1 | | | |
| process | component | | Phthalic anhydride | | | | 46.9 | 39.9 | | 47 | | |
| | (X) | (X2) | trimellitic anhydride | | | | | | | | | |
| | | | pyromellitic anhydride | | 10.9 | 20.4 | 24.8 | 4.9 | 22.8 | | | |
| | | | 4,4'-biphthalic 2anhydride | | | | | | | 11.1 | | |
| | | | 3,3',4,4'-benzophenonetetracarboxylate 2anhydride | | | | | | | | 16.0 | |
| | | | 4- (2,5-Dioxo-tetrahydrofuran-3-yl)-1,2,3,4-tetrahydronaphthalene-1,2-dicarboxylate anhydride | | | | | | | | | 13.4 |
| | | | naphthalene-1,4,5,8-tetracarboxylate 2anhydride | | | | | | | | | |
| | | | mezo-butane-1,2,3,4-tetracarboxylate 2anhydride | | | | | | | | | |
| | | | 1,3,5-benzenetricarboxylate | | | | | | | | | |
| | polyol component | | BPX-11 | | 291.3 | 284.1 | 270.1 | 287.4 | 281.3 | 270.7 | 287.6 | 289.5 |
| | (Y) | | BPE-20 | | | | | | | | | |
| | | | EG | | | | | | | | | |
| | diisocyanate (Z) | | MDI | | 27.9 | 27.2 | 24.6 | 25.4 | 27.1 | 27.2 | 27.5 | 27.7 |
| | catalyst | | PTSA | | 2.7 | 2.7 | 2.5 | 2.7 | 2.6 | 2.5 | 2.7 | 2.7 |
| | | | Nf2NH | | | | | | | | | |
| | solvent | | toluene | | 40 | 40 | 40 | 40 | 40 | 40 | 40 | 40 |
| | | synthesis temperature | | ° C. | 97 | 97 | 97 | 97 | 97 | 97 | 97 | 97 |
| | | aromatic ring concentration | | mol/kg | 4.6 | 4.6 | 5.2 | 5.8 | 4.6 | 5.3 | 4.5 | 4.6 |
| | | repeating unit concentration | | mol/kg | 0.12 | 0.12 | 0.34 | 0.02 | 0.34 | 0.13 | 0.15 | 0.13 |
| emulsification | | polyester resin | | g | 300 | 300 | 300 | 300 | 300 | 300 | 300 | 300 |
| | | methyl ethyl ketone | | g | 250 | 250 | 250 | 250 | 250 | 250 | 250 | 250 |
| | | isopropyl alcohol | | g | 50 | 50 | 50 | 50 | 50 | 50 | 50 | 50 |
| | | 5% ammonia water | | g | 26 | 35 | 45 | 20 | 41 | 20 | 26 | 26 |
| | | ion exchanged water | | g | 1,200 | 1,200 | 1,200 | 1,200 | 1,200 | 1,200 | 1,200 | 1,200 |
| | polyester resin | | Mw | g/mol | 16,000 | 30,000 | 45,000 | 7,500 | 45,000 | 15,000 | 15,000 | 17,000 |
| | property | | Tg | ° C. | 57 | 60 | 66 | 58 | 51 | 64 | 59 | 57 |
| | | | acid value | mgKOH/g | 14 | 26 | 32 | 6 | 29 | 11 | 14 | 14 |
| | resin latex (L) solid concentration | | | wt % | 20 | 20 | 20 | 20 | 20 | 20 | 20 | 20 |

TABLE 1-continued

| | | | | | manufacturing example 9 | manufacturing example 10 | manufacturing example 11 | manufacturing example 12 | manufacturing example 13 | manufacturing example 14 |
|---|---|---|---|---|---|---|---|---|---|---|
| | | resin latex (L) | | | L9 | L10 | L11 | L12 | L13 | L14 |
| polyester resin | | polyester resin (A1) | | | P9 | P10 | P11l | P12 | P13 | P14 |
| (A1) | carboxylic | (X1) | maleic acid anhydride | g | 66.7 | 71.8 | 67.3 | 67.1 | 54.8 | 33.6 |
| synthesis | acid | | succinic acid anhydride | | | | | | | 34.3 |
| process | component | | Phthalic anhydride | | | | | | | |
| | (X) | (X2) | trimellitic anhydride | | | | 9.7 | 9.7 | | |
| | | | pyromellitic anhydride | | | | | | 13.5 | |
| | | | 4,4'-biphthalic 2anhydride | | | | | | | |
| | | | 3,3',4,4'-benzophenonetetracarboxylate 2anhydride | | | | | | | |
| | | | 4- (2,5-Dioxo-tetrahydrofuran-3-yl)-1,2,3,4-tetrahydronaphthalene-1,2-dicarboxylate anhydride | | | | | | | |
| | | | naphthalene-1,4,5,8-tetracarboxylate 2anhydride | | 13.4 | | | | | |
| | | | mezo-butane-1,2,3,4-tetracarboxylate 2anhydride | | | 10.7 | | | | |
| | | | 1,3,5-benzenetricarboxylate | | | | | | | 9.6 |
| | polyol component | | BPX-11 | | 289.5 | | 292.2 | 291.2 | 238.1 | 292.2 |
| | (Y) | | BPE-20 | | 284.7 | | | | | |
| | | | EG | | | | | | | |
| | diisocyanate (Z) | | MDI | | 27.7 | 29.9 | 28 | 29.3 | 91.3 | 27.5 |
| | catalyst | | PTSA | | 2.7 | 2.9 | 2.7 | 2.7 | 2.2 | 2.7 |
| | | | Nf2NH | | | | | | | |
| | solvent | | toluene | | 40 | 40 | 40 | 40 | 40 | 40 |
| | | synthesis temperature | | ° C. | 97 | 97 | 97 | 97 | 97 | 97 |
| | | aromatic ring concentration | | mol/kg | 4.6 | 4.6 | 4.6 | 4.6 | 4.5 | 4.6 |
| | | repeating unit concentration | | mol/kg | 0.13 | 0.09 | 0.09 | | | 0.11 |
| emulsification | | polyester resin | | g | 300 | 300 | 300 | 300 | 300 | 300 |
| | | methyl ethyl ketone | | g | 250 | 250 | 250 | 250 | 250 | 250 |
| | | isopropyl alcohol | | g | 50 | 50 | 50 | 50 | 50 | 50 |
| | | 5% ammonia water | | g | 26 | 27 | 16 | 26 | 27 | 26 |
| | | ion exchanged water | | g | 1,200 | 1,200 | 1,200 | 1,200 | 1,200 | 1,200 |
| polyester resin | | Mw | | g/mol | 16,500 | 16,000 | 16,000 | 11,000 | 33,000 | 14,000 |
| property | | Tg | | ° C. | 60 | 54 | 54 | 51 | 58 | 50 |
| | | acid value | | mgKOH/g | 14 | 15 | 7 | 14 | 17 | 14 |
| | resin latex (L) solid concentration | | | wt % | 20 | 20 | 20 | 20 | 20 | 20 |

Further, in Table 1, "BPE-20" represents ethylene oxide 2 mol adduct of bisphenol A NEW POLE BPE-20 (product name) of SANYO CHEMICAL INDUSTRIES, LTD., "EG" represents ethylene glycol, and "Nf2NH" represents bis(1,1,2,2,3,3,4,4,4-nonafluorine-1-butane sulfonyl)imide (WAKO PURE CHEMICAL INDUSTRIES, LTD.).

Comparative Manufacturing Examples 1-13

Comparative Manufacturing Examples 1-13, except for changing the manufacturing conditions shown in Table 2, are the same as Manufacturing Example 1, amorphous polyester-based resins Q1-Q13 are synthesized, and amorphous polyester-based resin latexes F1-F13 including amorphous polyester-based resins Q1-Q13 are obtained.

However, in Comparative Manufacturing Examples 9-12, the synthesis time after adding the first polycarboxylic acid component X1 is 2 h. Also, in Comparative Manufacturing Examples 1-3 and 7, because the second polycarboxylic acid component X2 is not used, the second esterification process is not performed and the recovery process is performed after the urethane-extending process.

The manufacturing conditions and the physical properties of the amorphous polyester-based resins Q1-Q13 obtained by Comparative Manufacturing Examples 1-13 are shown in Table 2. Also, the manufacturing conditions of the amorphous polyester-based resin latexes F1-F13 including the amorphous polyester-based resins Q1-Q13 are shown in Table 2.

TABLE 2

| | | | | | Comparative manufacturing example 1 | Comparative manufacturing example 2 | Comparative manufacturing example 3 | Comparative manufacturing example 4 | Comparative manufacturing example 5 |
|---|---|---|---|---|---|---|---|---|---|
| | | resin latex (L) | | | F1 | F2 | F3 | F4 | F5 |
| polyester resin (A1) synthesis process | | polyester resin (A1) | | | Q1 | Q2 | Q3 | Q4 | Q5 |
| | carboxylic acid component (X) | (X1) | maleic acid anhydride | g | | | 13.3 | | 17.2 |
| | | | succinic acid anhydride | | 83.6 | 87.6 | | 68.5 | |
| | | | Phthalic anhydride | | | | 80.0 | | 60.7 |
| | | | terephthalic anhydride | | | | | | |
| | | (X2) | trimellitic anhydride | | | | | | |
| | | | pyromellitic anhydride | | | | | 34.3 | 22.1 |
| | polyol component (Y) | | BPX-11 | | | | | 267.1 | 270.4 |
| | | | BPE-20 | | 297.6 | 269.3 | 284.5 | | |
| | | | EG | | | 5.4 | | | |
| | diisocyanate (Z) | | MDI | | 15.5 | 34.2 | 19.6 | 27.4 | 27.3 |
| | catalyst | | PTSA | | 3.3 | 3.5 | 2.7 | 2.7 | 2.3 |
| | | | TBT | | | | | | |
| | solvent | | toluene | | 40 | 40 | 40 | 40 | 40 |
| | synthesis temperature | | | ° C. | 97 | 97 | 97 | 97 | 97 |
| | aromatic ring concentration | | | mol/kg | 4.6 | 4.6 | 5.7 | 4.6 | 5.5 |
| | repeating unit concentration | | | mol/kg | | | | 0.11 | 0.23 |
| | polyester resin | | | g | 300 | 300 | 300 | 300 | 300 |
| | methyl ethyl ketone | | | g | 250 | 250 | 250 | 250 | 250 |
| | isopropyl alcohol | | | g | 50 | 50 | 50 | 50 | 50 |
| | 5% ammonia water | | | g | 20 | 20 | 20 | 50 | 35 |
| | ion exchanged water | | | g | 1.200 | 1.200 | 1.200 | 1.200 | 1.200 |
| | polyester resin property | | Mw | g/mol | 15,000 | 40,000 | 5,000 | 70,000 | 14,000 |
| | | | Tg | ° C. | 40 | 40 | 54 | 54 | 68 |
| | | | acid value | mgKOH/g | 2 | 2 | 2 | 44 | 28 |
| | resin latex (L) solid concentration | | | wt % | 20 | 20 | 20 | 20 | 20 |

| | | | | | Comparative manufacturing example 6 | Comparative manufacturing example 7 | Comparative manufacturing example 8 | Comparative manufacturing example 9 | Comparative manufacturing example 10 |
|---|---|---|---|---|---|---|---|---|---|
| | | resin latex (L) | | | F6 | F7 | F8 | F9 | F10 |
| polyester resin (A1) synthesis process | | polyester resin (A1) | | | Q6 | Q7 | Q8 | Q9 | Q10 |
| | carboxylic acid component (X) | (X1) | maleic acid anhydride | g | | | | | |
| | | | succinic acid anhydride | | | | | 69.4 | |
| | | | Phthalic anhydride | | 96.1 | 95.1 | 97.1 | | |
| | | | terephthalic anhydride | | | | | | 111.7 |
| | | (X2) | trimellitic anhydride | | | | | 4.0 | 4.0 |
| | | | pyromellitic anhydride | | 28.8 | | 16.7 | | |
| | polyol component (Y) | | BPX-11 | | 249.1 | 273.6 | 256.1 | 312.5 | 247.4 |
| | | | BPE-20 | | | | | | |
| | | | EG | | | | | | |
| | diisocyanate (Z) | | MDI | | 23.4 | 28.8 | 27.4 | 11.2 | 29.0 |
| | catalyst | | PTSA | | 2.6 | 2.6 | 2.6 | 2.9 | |
| | | | TBT | | | | | | 3.6 |
| | solvent | | toluene | | 40 | 40 | 40 | 40 | 40 |
| | synthesis temperature | | | ° C. | 97 | 97 | 97 | 97 | 230 |
| | aromatic ring concentration | | | mol/kg | 5.9 | 5.9 | 5.9 | 4.7 | 5.9 |
| | repeating unit concentration | | | mol/kg | 0.21 | | 0.12 | | |
| | polyester resin | | | g | 300 | 300 | 300 | 300 | 300 |
| | methyl ethyl ketone | | | g | 250 | 250 | 250 | 250 | 250 |
| | isopropyl alcohol | | | g | 50 | 50 | 50 | 50 | 50 |
| | 5% ammonia water | | | g | 45 | 20 | 30 | 25 | 25 |
| | ion exchanged water | | | g | 1.200 | 1.200 | 1.200 | 1.200 | 1.200 |

TABLE 2-continued

| | | | | | | | |
|---|---|---|---|---|---|---|---|
| polyester resin property | Mw | g/mol | 60,000 | 8,000 | 30,000 | 6,000 | 15,000 |
| | Tg | ° C. | 70 | 64 | 69 | 40 | 60 |
| | acid value | mgKOH/g | 37 | 2 | 22 | 8 | 8 |
| resin latex (L) solid concentration | | wt % | 20 | 20 | 20 | 20 | 20 |

| | | | | | Comparative manufacturing example 11 | comparative manufacturing example 12 | comparative manufacturing example 13 |
|---|---|---|---|---|---|---|---|
| resin latex (L) | | | | | F11 | F12 | F13 |
| polyester resin (A1) synthesis process | polyester resin (A1) | | | | Q11 | Q12 | Q13 |
| | carboxylic acid component (X) | (X1) | maleic acid anhydride | g | | | |
| | | | succinic acid anhydride | | | | |
| | | | Phthalic anhydride | | 102.0 | | |
| | | | terephthalic anhydride | | | 120.9 | |
| | | (X2) | trimellitic anhydride | | 4.0 | 4.0 | |
| | | | pyromellitic anhydride | | | | 22.9 |
| | polyol component (Y) | | BPX-11 | | 279.8 | 269.8 | 210.6 |
| | | | BPE-20 | | | | |
| | | | EG | | | | |
| | diisocyanate (Z) | | MDI | | 11.3 | | 41.1 |
| | catalyst | | PTSA | | 2.9 | | 3.9 |
| | | | TBT | | | 3.9 | |
| | solvent | | toluene | | 40 | 40 | 40 |
| | synthesis temperature | | | ° C. | 97 | 230 | 97 |
| | aromatic ring concentration | | | mol/kg | 6.1 | 5.9 | 3.9 |
| | repeating unit concentration | | | mol/kg | | | 0.15 |
| | polyester resin | | | g | 300 | 300 | 300 |
| | methyl ethyl ketone | | | g | 250 | 250 | 250 |
| | isopropyl alcohol | | | g | 50 | 50 | 50 |
| | 5% ammonia water | | | g | 25 | 25 | 35 |
| | ion exchanged water | | | g | 1.200 | 1.200 | 1.200 |
| | polyester resin property | | Mw | g/mol | 8,000 | 40,000 | 35,000 |
| | | | Tg | ° C. | 55 | 62 | 45 |
| | | | acid value | mgKOH/g | 8 | 8 | 29 |
| | resin latex (L) solid concentration | | | wt % | 20 | 20 | 20 |

Further, in Table 2, "BPE-20" represents the ethylene oxide 2 mol adduct of bisphenol A (NEW POLE BPE-20 (product name) of SANYO CHEMICAL INDUSTRIES, LTD.), and "EG" represents ethylene glycol.

Next, Manufacturing Example 15 of the amorphous polyester-based resin latex including the two types of amorphous polyester-based resins used in the embodiment will be described.

Manufacturing Example 15

The amorphous polyester-based resin P1 at 150 g, the amorphous polyester-based resin P2 at 150 g, the methyl ethyl ketone (MEK) at 250 g, and the isopropyl alcohol (IPA) at 50 g are put into the 3 L double jacket reaction container. Next, under an environment of about 30° C., while stirring the inside of the reaction container by using the half-moon-shaped impeller, the amorphous polyester-based resins P1 and P2 are dissolved in the mixture solvent of the methyl ethyl ketone and the isopropyl alcohol. While stirring the inside of the reaction container, the 5% aqueous ammonia solution at 27 g is slowly and continuously added to the reaction container, and ion exchanged water at 1,200 g is added at a 20 g/min speed to form the liquid emulsion.

Next, the mixture solvent of the methyl ethyl ketone and the isopropyl alcohol is removed from the liquid emulsion by the vacuum distillation method until the concentration of the solid amorphous polyester-based resin P1 and P2 reaches 20 wt %, and the amorphous polyester-based resin latex L15 is obtained.

The manufacturing example of the crystalline polyester resin latex including the crystalline polyester resin used in the embodiment and the comparative example will now be described.

Manufacturing Example 16

1,9-nonanediol (WAKO PURE CHEMICAL IDUSTRIES, LTD.) at 198.8 g, dodecanedioic acid (WAKO PURE CHEMICAL INDUSTRIES, LTD.) at 250.8 g, para-toluene sulfonic acid monohydrate (PTSA, WAKO PURE CHEMICAL INDUSTRIES, LTD.) at 0.45 g are put into a 500 mL separable flask. Next, nitrogen is introduced inside the flask, and while stirring the inside of the flask by the stirrer, the mixture of 1,9-nonanediol, dodecanedioic acid, and para-toluenesulfonic acid 1 hydrate is heated to 80° C. to be dissolved. While stirring the inside of the flask, the temperature of the mixture solution in the flask is increased to 97° C. The inside of the flask is then placed under vacuum (10 mPa's or less), and while stirring the inside of the flask at the temperature of 97° C. for 5 h, the dehydration condensation reaction of 1,9-nonanediol and dodecanedioic acid is performed, and the crystalline polyester resin P16 is obtained.

The crystalline polyester resin P16 has a weight average molecular weight of 6,000, and the content of the weight average molecular weight of 1,000 or less is 7.2%. Also, the melting point (endothermic peak temperature) found by the differential scanning calorimeter is 70.1° C., and in the differential scanning calorimetry curve, the difference of the endothermic start temperature and the endothermic peak temperature while increasing the temperature is 4.3° C., and the endothermic amount in the fusing is 3.4 W/g. Also, the acid value is 9.20 mgKOH/g, and the sulfur content is 186.62 ppm.

Next, crystalline polyester resin P16 at 300 g, methyl ethyl ketone (MEK) at 250 g, and isopropyl alcohol (IPA) at 50 g are put into a 3 L double jacket reaction container. Next, under an environment of about 30° C., while stirring the inside of the reaction container by using the half-moon shape impeller, the crystalline polyester resin P16 is dissolved in the mixture solvent of methyl ethyl ketone and isopropyl alcohol. While stirring the inside of the reaction container, the 5% aqueous ammonia solution at 25 g is slowly and continuously added into the reaction container, and ion exchanged water at 1,200 g is added at a 20 g/min speed, thereby forming the liquid emulsion. Next, the mixture solvent of methyl ethyl ketone and isopropyl alcohol is removed from the liquid emulsion by the vacuum distillation method until the concentration of the solid crystalline polyester resin P16 reaches 20 wt %, and the crystalline polyester resin latex L16 is obtained.

Manufacturing Examples 17-18

Manufacturing Examples 17-18, as shown in Table 3, except for the manufacturing conditions, are the same as Manufacturing Example 16, the crystalline polyester resins P17-P18 are synthesized, and the crystalline polyester resin latexes L17-L18 are obtained.

The manufacturing conditions and the physical properties of the crystalline polyester resins P16-P18 obtained in Manufacturing Examples 16-18 are shown in Table 3.

TABLE 3

| | | Manufacturing Example 16 | Manufacturing Example17 | Manufacturing Example 18 |
|---|---|---|---|---|
| Composition | 1.9-ND (g) | 198.8 | 198.8 | 198.8 |
| | DDA (g) | 250.8 | 242.2 | 250.8 |
| | PTSA (g) | 0.45 | 0.45 | — |
| | Nf2NH (g) | — | — | 0.16 |
| | TBT (g) | — | — | — |
| Reaction condition | Reaction temperature (° C.) | 97 | 97 | 97 |
| | Reaction time (h) | 5 | 8 | 4 |
| Molecular weight data | MW | 6,000 | 13,000 | 5,800 |
| | 1,000 or less content (%) | 7.2 | 3.5 | 7.6 |
| DSC data | Endothermic amount (W/g) | 3.4 | 3.4 | 3.4 |
| | Endothermic peak temperature (° C.) | 70.1 | 71.6 | 69.8 |
| | Endothermic start temperature (° C.) | 65.8 | 67.9 | 65.6 |
| | Endothermic peak – endothermic start (° C.) | 4.3 | 3.7 | 4.2 |
| AV (mgKOH/g) | | 9.2 | 5.1 | 9.3 |
| Quantitative data | S (ppm) | 186.62 | 190.26 | 19.64 |
| | F (ppm) | — | — | 209.41 |

Further, in Table 3, "1.9-ND" represents the input amount of 1,9-noanediol, "DDA" represents the input amount of dodecanedioic acid, "PTSA" represents the input amount of para-toluenesulfonic acid monohydrate, "Nf2NH" represents the input amount of bis(1,1,2,2,3,3,4,4,4-ninafluorine-1-butane sulfonyl)imide, and "TBT" represents the input amount of tetra-n-butoxy titanium. Also, in Table 3, "MW" represents the weight average molecular weight, and "1,000 or less content" represents the content of the weight average molecular weight of 1,000 or less. Further, "endothermic peak-endothermic state" represents the difference of the endothermic start temperature and the endothermic peak temperature while increasing the temperature. In addition, "AV" represents the acid value, "S" represents the content of the sulfur element, and "F" represents the content of the fluorine element.

Next, Manufacturing Example 19 of the colorant dispersion solution including the colorant used in the embodiment and the comparative example will be described.

Manufacturing Example 19

A cyan pigment (PB 15:3 (C.I. number)) at 60 g and an anionic reactive surfactant (HS-10 (product name) manufactured by DAIICHI PHARMACEUTICAL INDUSTRY) at 10 g are put in a milling bath, and glass beads at 400 g with a diameter of 0.8-1 mm are introduced thereto. Next, the milling is performed in the milling bath at room temperature, and the colorant dispersion solution is obtained.

Next, Manufacturing Example 20 of the release agent dispersion solution including the release agent used in the embodiment and the comparative example will be described.

Manufacturing Example 20

Paraffin wax (HNP-9 (product name) of JAPAN SEIRO CO., LTD.) at 270 g, the anionic surfactant (DOWFAX2 Å 1 (product name) of DOW CHEMICAL CO., LTD.) at 2.7 g, and the ion exchanged water at 400 g are put in a reaction container. Next, the inside of the reaction container is heated to 110° C. and the dispersion is performed by using a homogenizer (ULTRATURRAX T50 (product name) manufactured by IKA company), and the dispersion is also performed by using a high pressure homogenizer (NANOVATER NVL-ES008 (product name) of YOSHIDA MACHINERY CO., LTD.), thereby obtaining the release agent dispersion solution.

The manufacturing method of the toner for developing the electrostatic charge image of the embodiment and the comparative example will now be described.

Embodiment 1

The amorphous polyester-based resin latex L1 at 600 g as the resin latex for forming the core, the crystalline polyester resin latex L16 at 100 g as the resin latex for forming the core, and deionized water at 560 g are put in a 3 L reaction container. Next, while stirring the inside of the reaction container, the colorant dispersion solution at 70 g obtained from Manufacturing Example 19 and the release agent dispersion solution at 80 g obtained from Manufacturing Example 20 are added into the reaction container, and nitric acid at 30 g with a concentration of 0.3 N and polysilicate iron PSI-100 (SUIDO KIKO KAISHA, LTD.) at 25 g are added thereto. Next, while stirring the inside of the reaction container by using a homogenizer (ULTRATURRAX T50 (product name) manufactured by IKA company, the temperature of the mixture solution in the flask is increased at a 1° C./min speed to 50° C., and the amorphous polyester-based resin P1, the crystalline polyester resin P16, the colorant, and the release agent are aggregated until the first aggregation particles of the predetermined volume average particle size are obtained, and the temperature is increased at a 0.03° C./min speed, thereby forming the first aggregation particles with a volume average particle size of 5.2 μm. The predetermined volume average particle size of the first aggregation particle is confirmed by taking out part of the mixture solution from the reaction container and analyzing the first aggregation particles included in the solution.

Next, while stirring the inside of the reaction container, the amorphous polyester-based resin latex L1 at 300 g as the resin latex for forming the shell is added to the reaction container, during 30 min, the first aggregation particle and the amorphous polyester-based resin P1 are aggregated, thereby the coating layer made of the amorphous polyester-based resin P1 is formed on the outer surface of the first aggregation particle, and as a result, the coated aggregation particle is obtained. Next, a sodium hydroxide aqueous solution of a concentration 0.1 N is added into the reaction container, and the pH of the mixture solution in the reaction container is adjusted to 9.5. After 20 min, the temperature of the mixture solution in the reaction container is increased to 83° C., during 2 h, and the particles in the coated aggregation particle are unity-fused, thereby forming the toner particle including the coating layer on the outer surface thereof.

After cooling the mixture solution in the reaction container to 28° C. or less, the toner particles are removed by filtering the mixture solution, then the toner particles are dried to obtain the toner 1 for developing the electrostatic charge image.

For the obtained toner 1 for developing the electrostatic charge image, the content of the sulfur element is 945 ppm, the content of the iron element is 2,212 ppm, and the content of the silicon element is 2,212 ppm. Further, the acid value is 12 mgKOH/g. Also, the volume average particle size is 5.8 μm, the presence amount of the particle having the particle size of 3 μm or less is 1.9 number percent, the presence amount of the particle having the particle size of 1 μm or less is 0.5 number percent, and the ratio of the presence amount of the particle having the particle size of 3 μm or less to the presence amount of the particle having the particle size of 1 μm or less is 3.8.

The fixing temperature of the obtained toner 1 for developing the electrostatic charge image is 120° C., the preservability estimation is ○, and the charging property estimation is ○. Also, the thickness of the coating layer is 0.3 μm.

Embodiments 2-17 and Comparative Examples 1-13

Embodiments 2-17 and Comparative Examples 1-13, as shown in Table 4 and Table 5, except for changing the manufacturing conditions, are the same as Embodiment 1, thereby obtaining the toners 2-30 for developing the electrostatic charge image.

However, in Embodiment 4 and Comparative Examples 6-9, as the resin latex for forming the core, the crystalline polyester resin latex is not used.

On the other hand, in Embodiments 2 to 17 and Comparative Examples 1 to 13, the volume average particle size of the first aggregation particle is between 4 and 5 μm. Also, the pH of the mixture solution in the fusion reaction when forming the toner particle is between 7.5 and 9.0, the fusion reaction temperature is between 80 and 90° C., and the fusion reaction time is between 3 and 5 h. Further, the thickness of the coating layer is between 0.2 and 1 μm.

The manufacturing conditions and the physical properties of the toners 1 to 30 for developing the electrostatic charge image of Embodiments 1 to 17 and Comparative Examples 1 to 13 are shown in Table 4 and Table 5.

TABLE 4

| | | | Embodiment 1 | Embodiment 2 | Embodiment 3 | Embodiment 4 | Embodiment 5 | Embodiment 6 |
|---|---|---|---|---|---|---|---|---|
| Toner No. | | | Toner 1 | Toner 2 | Toner 3 | Toner 4 | Toner 5 | Toner 6 |
| resin latex (L) | core latex | core 1 | L1 | L2 | L3 | L4 | L5 | L6 |
| | | core 2 | L16 | L16 | L16 | | L16 | L16 |
| | shell latex | | L1 | L2 | L3 | L1 | L5 | L6 |
| | wax dispersion solution | | HNP-9 | HNP-9 | HNP-9 | HNP-9 | HNP-9 | HNP-9 |
| | cyan pigment dispersion solution | | HS-10 | HS-10 | HS-10 | HS-10 | HS-10 | HS-10 |
| | PSI | | PSI100 | PSI100 | PSI100 | PSI100 | PSI100 | PSI100 |
| core emulsion | core 1 | g | 600 | 600 | 600 | 600 | 600 | 600 |
| | core 2 | g | 100 | 100 | 100 | | 100 | 100 |
| | shell emulsion | g | 300 | 300 | 300 | 300 | 300 | 300 |
| | wax dispersion solution | g | 80 | 80 | 80 | 80 | 80 | 80 |
| | cyan pigment dispersion solution | g | 70 | 70 | 70 | 70 | 70 | 70 |
| | PSI | g | 25 | 25 | 25 | 25 | 25 | 25 |
| Toner physical property value | sulfur element content | ppm | 945 | 919 | 868 | 996 | 868 | 868 |
| | iron element content | ppm | 2,212 | 2,212 | 2,212 | 2,212 | 2,212 | 2,212 |
| | silicon element content | ppm | 2,212 | 2,212 | 2,212 | 2,212 | 2,212 | 2,212 |
| | fluorine element content | ppm | | | | | | 1,196 |
| | acid value | mgKOH/g | 12 | 22 | 26 | 7 | 24 | 9 |
| | Dv50 | μm | 5.8 | 5.6 | 5.9 | 6.1 | 6.2 | 5.8 |
| | 3μ ↓ % | number % | 1.9 | 3.0 | 3.0 | 2.4 | 2.9 | 2.8 |
| | 1μ ↓ % | number % | 0.5 | 1.5 | 1.3 | 0.9 | 0.9 | 1.3 |
| | 3μ↓/1μ ↓ | — | 3.8 | 2.0 | 2.3 | 2.7 | 3.2 | 2.2 |
| Toner estimation | preservability | | ○ | ○ | ○ | ○ | ○ | ○ |
| | fixing temperature (° C.) | | 120 | 125 | 130 | 120 | 120 | 120 |
| | charging property | | ○ | ○ | ○ | ○ | ○ | ○ |

| | | | Embodiment 7 | Embodiment 8 | Embodiment 9 | Embodiment 10 | Embodiment 11 | Embodiment 12 |
|---|---|---|---|---|---|---|---|---|
| Toner No. | | | Toner 7 | Toner 8 | Toner 9 | Toner 10 | Toner 11 | Toner 12 |
| resin latex (L) | core latex | core 1 | L7 | L8 | L9 | L10 | L11 | L12 |
| | | core 2 | L16 | L16 | L16 | L16 | L16 | L16 |
| | shell latex | | L7 | L8 | L9 | L10 | L11 | L12 |
| | wax dispersion solution | | HNP-9 | HNP-9 | HNP-9 | HNP-9 | HNP-9 | HNP-9 |
| | cyan pigment dispersion solution | | HS-10 | HS-10 | HS-10 | HS-10 | HS-10 | HS-10 |
| | PSI | | PSI100 | PSI100 | PSI100 | PSI100 | PSI100 | PSI100 |
| core emulsion | core 1 | g | 600 | 600 | 600 | 600 | 600 | 600 |
| | core 2 | g | 100 | 100 | 100 | 100 | 100 | 100 |

TABLE 4-continued

| | | | | | | | | |
|---|---|---|---|---|---|---|---|---|
| | shell emulsion | g | 300 | 300 | 300 | 300 | 300 | 300 |
| | wax dispersion solution | g | 80 | 80 | 80 | 80 | 80 | 80 |
| | cyan pigment dispersion solution | g | 70 | 70 | 70 | 70 | 70 | 70 |
| | PSI | g | 25 | 25 | 25 | 25 | 25 | 25 |
| Toner physical property value | sulfur element content | ppm | 868 | 894 | 894 | 894 | 894 | 792 |
| | iron element content | ppm | 2,212 | 2,212 | 2,212 | 2,212 | 2,212 | 2,212 |
| | silicon element content | ppm | 2,212 | 2,212 | 2,212 | 2,212 | 2,212 | 2,212 |
| | fluorine element content | ppm | | | | | | |
| | acid value | mgKOH/g | 12 | 12 | 12 | 13 | 7 | 12 |
| | Dv50 | μm | 5.8 | 5.9 | 6.0 | 6.0 | 6.1 | 6.0 |
| | 3μ ↓ % | number % | 2.5 | 2.9 | 2.9 | 3.0 | 2.7 | 2.7 |
| | 1μ ↓ % | number % | 0.7 | 1.1 | 1.2 | 1.5 | 1.2 | 1.3 |
| | 3μ↓/1μ ↓ | — | 3.6 | 2.6 | 2.4 | 2.0 | 2.3 | 2.1 |
| Toner estimation | preservability | | ○ | ○ | ○ | ○ | ○ | ○ |
| | fixing temperature (° C.) | | 120 | 120 | 120 | 120 | 125 | 125 |
| | charging property | | ○ | ○ | ○ | ○ | ○ | ○ |

| | | | Embodiment 13 | Embodiment 14 | Embodiment 15 | Embodiment 16 | Embodiment 17 |
|---|---|---|---|---|---|---|---|
| Toner No. | | | Toner 13 | Toner 14 | Toner 15 | Toner 16 | Toner 17 |
| resin latex (L) | core latex | core 1 | L13 | L14 | L15 | L1 | L5 |
| | | core 2 | L16 | L16 | L16 | L17 | L18 |
| | shell latex | | L13 | L14 | L2 | L1 | L5 |
| | wax dispersion solution | | HNP-9 | HNP-9 | HNP-9 | HNP-9 | HNP-9 |
| | cyan pigment dispersion solution | | HS-10 | HS-10 | HS-10 | HS-10 | HS-10 |
| | PSI | | PSI100 | PSI100 | PSI100 | PSI100 | PSI100 |
| core emulsion | core 1 | g | 600 | 600 | 600 | 600 | 600 |
| | core 2 | g | 100 | 100 | 100 | 100 | 100 |
| | shell emulsion | g | 300 | 300 | 300 | 300 | 300 |
| | wax dispersion solution | g | 80 | 80 | 80 | 80 | 80 |
| | cyan pigment dispersion solution | g | 70 | 70 | 70 | 70 | 70 |
| | PSI | g | 25 | 25 | 25 | 50 | 13 |
| Toner physical property value | sulfur element content | ppm | 792 | 945 | 945 | 945 | 945 |
| | iron element content | ppm | 2,212 | 2,212 | 2,212 | 7,743 | 1,150 |
| | silicon element content | ppm | 2,212 | 2,212 | 2,212 | 7,743 | 1,150 |
| | fluorine element content | ppm | | | | | 1,380 |
| | acid value | mgKOH/g | 15 | 12 | 18 | 12 | 12 |
| | Dv50 | μm | 6.0 | 6.0 | 5.7 | 6.8 | 5.6 |
| | 3μ ↓ % | number % | 3.0 | 3.0 | 3.0 | 2.0 | 3.0 |
| | 1μ ↓ % | number % | 1.4 | 1.2 | 10 | 0.8 | 1.4 |
| | 3μ↓/1μ ↓ | — | 2.1 | 2.5 | 3.0 | 2.5 | 2.1 |
| Toner estimation | preservability | | ○ | ○ | ○ | ○ | ○ |
| | fixing temperature (° C.) | | 125 | 125 | 120 | 120 | 120 |
| | charging property | | ○ | ○ | ○ | ○ | ○ |

In the upper part of Table 4, "wax dispersion solution" represents the type of wax in the wax dispersion solution used when forming the first aggregation particle, "cyan pigment dispersion solution" represents the type of anionic reactive surfactant in the colorant dispersion solution used when forming the first aggregation particle, and "PSI" represents the type of flocculant used when forming the first aggregation particle.

TABLE 5

| | | | Comparative example 1 | Comparative example 2 | Comparative example 3 | Comparative example 4 | Comparative example 5 | Comparative example 6 | Comparative example 7 |
|---|---|---|---|---|---|---|---|---|---|
| Toner No. | | | Toner 18 | Toner 19 | Toner 20 | Toner 21 | Toner 22 | Toner 23 | Toner 24 |
| resin latex (L) | core latex | core 1 | F1 | F2 | F3 | F4 | F5 | F6 | F7 |
| | | core 2 | L16 | L16 | L16 | L16 | F4 | | |
| | shell latex | | F1 | F2 | F3 | F4 | F5 | F6 | F7 |
| | wax dispersion solution | | HNP-9 | HNP-9 | HNP-9 | HNP-9 | HNP-9 | HNP-9 | HNP-9 |
| | cyan pigment dispersion solution | | HS-10 | HS-10 | HS-10 | HS-10 | HS-10 | HS-10 | HS-10 |
| | PSI | | PSI100 | PSI100 | PSI100 | PSI100 | PSI100 | PSI100 | PSI100 |
| core emulsion | core 1 | g | 600 | 600 | 600 | 600 | 600 | 600 | 600 |
| | core 2 | g | 100 | 100 | 100 | 100 | 100 | 100 | 100 |
| | shell emulsion | g | 300 | 300 | 300 | 300 | 300 | 300 | 300 |
| | wax dispersion solution | g | 80 | 80 | 80 | 80 | 80 | 80 | 80 |
| | cyan pigment dispersion solution | g | 70 | 70 | 70 | 70 | 70 | 70 | 70 |
| | PSI | g | 25 | 25 | 25 | 50 | 25 | 25 | 15 |
| Toner physical property value | sulfur element content | ppm | 1,033 | 990 | 1,023 | 888 | 1,014 | 929 | 995 |
| | iron element content | ppm | 2,212 | 2,212 | 2,212 | 7,743 | 2,212 | 2,212 | 1,327 |
| | silicon element content | ppm | 2,212 | 2,212 | 2,212 | 7,743 | 2,212 | 2,212 | 1,327 |
| | acid value | mgKOH/g | 2.0 | 2.0 | 2.0 | 36.0 | 28.0 | 29.0 | 2.0 |
| | Dv50 | μm | 7.0 | 6.8 | 6.8 | 6.0 | 5.9 | 6.1 | 6.6 |
| | 3μ ↓ % | number % | 6.1 | 5.5 | 5.0 | 4.0 | 4.0 | 4.5 | 3.0 |
| | 1μ ↓ % | number % | 2.5 | 2.3 | 1.9 | 2.2 | 2.0 | 2.5 | 1.3 |
| | 3μ↓/1μ ↓ | — | 2.4 | 2.4 | 2.6 | 1.8 | 2.0 | 1.8 | 2.3 |

TABLE 5-continued

| | | | | | | | | |
|---|---|---|---|---|---|---|---|---|
| Toner estimation | preservability | X | X | X | ○ | ○ | ○ | ○ |
| | fixing temperature (° C.) | 120 | 120 | 120 | 150 | 145 | 140 | 130 |
| | charging property | Δ | Δ | Δ | ○ | ○ | ○ | Δ |

| | | | Comparative example 8 | Comparative example 9 | Comparative example 10 | Comparative example 11 | Comparative example 12 | Comparative example 13 |
|---|---|---|---|---|---|---|---|---|
| Toner No. | | | Toner 25 | Toner 26 | Toner 27 | Toner 28 | Toner 29 | Toner 30 |
| resin latex (L) | core latex | core 1 | F8 | F9 | F10 | F11 | F12 | F13 |
| | | core 2 | | | L16 | L16 | L16 | L16 |
| | shell latex | | F8 | F9 | F10 | F11 | F12 | F13 |
| | wax dispersion solution | | HNP-9 | HNP-9 | HNP-9 | HNP-9 | HNP-9 | HNP-9 |
| | cyan pigment dispersion solution | | HS-10 | HS-10 | HS-10 | HS-10 | HS-10 | HS-10 |
| | PSI | | PSI100 | PSI100 | PSI100 | PSI100 | PSI100 | PSI100 |
| core emulsion | core 1 | g | 600 | 600 | 600 | 600 | 600 | 600 |
| | core 2 | g | 100 | 100 | 100 | 100 | 100 | 100 |
| | shell emulsion | g | 300 | 300 | 300 | 300 | 300 | 300 |
| | wax dispersion solution | g | 80 | 80 | 80 | 80 | 80 | 80 |
| | cyan pigment dispersion solution | g | 70 | 70 | 70 | 70 | 70 | 70 |
| | PSI | g | 25 | 25 | 25 | 25 | 25 | 25 |
| Toner physical property value | sulfur element content | ppm | 952 | 1,043 | | 1,047 | | 1,047 |
| | iron element content | ppm | 2,212 | 2,212 | 2,212 | 2,212 | 2,212 | 2,212 |
| | silicon element content | ppm | 2,212 | 2,212 | 2,212 | 2,212 | 2,212 | 2,212 |
| | acid value | mgKOH/g | 17.0 | 6.0 | 7.0 | 7.0 | 7.0 | 24.0 |
| | Dv50 | μm | 5.7 | 6.5 | 6.6 | 6.4 | 6.2 | 5.5 |
| | 3μ ↓ % | number % | 2.8 | 2.0 | 2.6 | 3.1 | 3.3 | 3.0 |
| | 1μ ↓ % | number % | 1.0 | 1.0 | 1.2 | 1.5 | 1.6 | 0.9 |
| | 3μ↓/1μ ↓ | — | 2.8 | 2.0 | 2.2 | 2.1 | 2.1 | 3.3 |
| Toner estimation | preservability | | ○ | X | ○ | ○ | ○ | X |
| | fixing temperature (° C.) | | 140 | 120 | 140 | 140 | 145 | 120 |
| | charging property | | ○ | Δ | ○ | ○ | ○ | ○ |

On the other hand, in the upper part of Table 5, "wax dispersion solution" represents the type of wax in the wax dispersion solution used when forming the first aggregation particle, "cyan pigment dispersion solution" represents the type of anionic reactive surfactant in the colorant dispersion solution used when forming the first aggregation particle, and "PSI" represents the type of flocculant used when forming the first aggregation particle.

As shown in Table 4, for the toners 1 to 17 for developing the electrostatic charge image of Embodiments 1 to 17, the fixing temperature is 130° C. or less, and the low temperature fixability is excellent. Also, for the toners 1 to 17 for developing the electrostatic charge image of Embodiments 1 to 17, as each preservability estimation is ○, the preservability is excellent. Further, for the toners 1 to 17 for developing the electrostatic charge image of Embodiments 1 to 17, as the charging property is estimated as ○, the charging property that is suitable to be used for the toner appears.

In contrast, for the toners 18 to 20, 26 and 30 for developing the electrostatic charge image of Comparative Examples 1 to 3, 9, and 13, as the preservability is estimated as x, the preservability is deteriorated. For the tonesr 18 and 19 for developing the electrostatic charge image of the Comparative Examples 1 and 2, it is considered that this is due to the glass transition temperature of the polyester resins Q1 and Q2 being 40° C. that is lower than 50° C. Also, for the toner 20 for developing the electrostatic charge image of Comparative Example 3, it is considered that this is due to the weight average molecular weight of the polyester resin Q3 being 5,000 that is smaller than 7,000. For the toner 26 for developing the electrostatic charge image of the Comparative Example 9, it is considered that this is due to (1) the glass transition temperature of the polyester resin Q9 being 40° C. that is lower than 50° C., and (2) the weight average molecular weight of the polyester resin Q9 being 6,000 that is lower than 7,000. For the toner 30 for developing the electrostatic charge image of the Comparative Example 13, it is considered that this is due to (1) the aromatic ring concentration of the polyester resin Q13 being 3.9 mol/kg that is lower than 4.5 mol/kg, and (2) the glass transition temperature of the polyester resin Q13 being 45° C. that is lower than 50° C.

For the toner 21 for developing the electrostatic charge image of the Comparative Example 4, because the fixing temperature at 150° C. exceeds 130° C., the low temperature fixability is deteriorated. For the toner 21 for developing the electrostatic charge image of the Comparative Example 4, it is considered that this is due to the weight average molecular weight of the polyester resin Q4 being 70,000 that is larger than 50,000. For the toner 22 for developing the electrostatic charge image of the Comparative Example 5, because the fixing temperature at 145° C. exceeds 130° C., the low temperature fixability is inferior. For the toner 22 for developing the electrostatic charge image of the Comparative Example 5, it is considered that this is due to the glass transition temperature of the polyester resin Q5 being 68° C. that does not satisfy the above-described Equation 2: $Tg=2.67\times\ln(MW)+b$ (where $21.07\leq b\leq 39.48$). For the toner 23 for developing the electrostatic charge image of the Comparative Example 6, because the fixing temperature of 140° C. exceeds 130° C., the low temperature fixability is inferior. For the toner 23 for developing the electrostatic charge image of the Comparative Example 6, it is considered that this is due to (1) the aromatic ring concentration of the polyester resin Q6 being 5.9 mol/kg that is larger than 5.8 mol/kg, and (2) the weight average molecular weight of the polyester resin Q6 being 60,000 that is larger than 50,000. For the toner 25 for developing the electrostatic charge image of the Comparative Example 8, because the fixing temperature of 140° C. exceeds 130° C., the low temperature fixability is inferior. For the toner 25 for developing the electrostatic charge image of the Comparative Example 8, it is considered that this is due to (1) the aromatic ring concentration of the polyester resin Q8 being 5.9 mol/kg that is larger than 5.8 mol/kg, and (2) the glass transition temperature of polyester resin Q8 being 69° C. that does not satisfy the above-described Equation 2: Tg=2.67×ln (MW)+b (where 21.07≤b≤39.48). For the toners 27, 28 and 29 for developing the electrostatic charge image of the Comparative Examples 10, 11, and 12, because each fixing temperature as 140° C., 140° C., and 145° C. exceeds 130° C., the low temperature fixability is inferior. For the toners 27, 28 and 29 for developing the electrostatic charge image of the Comparative Examples 10, 11, and 12, it is considered that this is due to each aromatic ring concentration of the polyester resins Q10, Q11, and Q12 being 5.9 mol/kg, 6.1 mol/kg, and 5.9 mol/kg, that are larger than 5.8 mol/kg.

For the toners 18 to 20, 24, and 26 for developing the electrostatic charge image of the Comparative Examples 1 to 3, 7, and 9, the charging property is estimated as Δ, so the charging property toner that is suitable to be used as the toner does not appear. For the toners 18 to 20 and 24 for developing the electrostatic charge image of Comparative Examples 1-3 and 7, it is considered that this is due to the acid value being 2 mgKOH/g that is smaller than 3 mgKOH/g. For the toner 24 for developing the electrostatic charge image of Comparative Example 7, it is considered that this is due to the glass transition temperature of the polyester resin Q7 being 64° C. that does not satisfy the above-described Equation 1: Tg=7.26×ln (MW)+a (where −19.33≤a≤−4.29). For the toner 26 for developing the electrostatic charge image of Comparative Example 9, it is considered that this is due to the glass transition temperature of the polyester resin Q9 being 40° C. that is lower than 50° C.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A toner for developing an electrostatic charge image, the toner comprising:

toner particles comprising:

three or more elements selected from a group consisting of an iron element, a silicon element, a sulfur element, and a fluorine element, wherein, when included, a content of the iron element in the toner is in a range of $1.0\times10^3$ to $1.0\times10^4$ ppm, a content of the silicon element in the toner is in a range of $1.0\times10^3$ to $8.0\times10^3$ ppm, a content of the sulfur element in the toner is in a range of 500 to 3,000 ppm, and a content of the fluorine element is in a range of $1.0\times10^3$ to $1.0\times10^4$ ppm based on a total weight of the toner particles; and a binder resin comprising an amorphous polyester-based resin, wherein:

an aromatic ring concentration of the amorphous polyester-based resin is in a range of 4.5 to 5.8 mol/kg;

a weight average molecular weight (MW) of the amorphous polyester-based resin is in a range of 7,000 to 50,000;

a glass transition temperature (Tg) of the amorphous polyester-based resin is in a range of 50 to 70° C.; and if a weight average molecular weight (MW) of the amorphous polyester-based resin is in a range of 7,000 or more to less than 14,000, Equation 1 is satisfied, and if the weight average molecular weight (MW) is in a range of 14,000 or more to 50,000 or less, Equation 2 is satisfied:

$$Tg=7.26\times\ln(MW)+a(\text{where } -19.33\leq a\leq -4.29) \quad \text{(Equation 1)}$$

$$Tg=2.67\times\ln(MW)+b(\text{where } 21.07\leq b\leq 39.48). \quad \text{(Equation 2)}$$

2. The toner of claim 1, wherein:

the amorphous polyester-based resin has a polycarboxylic acid component as a structural unit, and the polycarboxylic acid component has a substituent group corresponding to three or more carboxyl groups.

3. The toner of claim 1, wherein:

the amorphous polyester-based resin comprises a structural unit represented by one selected from a group consisting of Formulae 1 to 7:

(Formula 1)

(1)

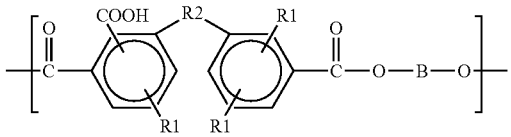

wherein:

R1 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group;

R2 is a carbonyl group, a sulfonyl group, or an oxygen atom; and

B is a divalent substituted or unsubstituted linear aliphatic hydrocarbon group, a divalent substituted or unsubstituted branched aliphatic hydrocarbon group, a divalent substituted or unsubstituted cyclic aliphatic hydrocarbon group, a divalent substituted or unsubstituted aromatic hydrocarbon group, a substituted or unsubstituted diphenylmethylene group, a divalent functional group including an ester bond having a substituted or unsubstituted linear aliphatic hydrocarbon group at each end, a divalent functional group including an ester bond and a urethane bond having a substituted or unsubstituted linear aliphatic hydrocarbon group at each end, a divalent functional group including an ester bond having a substituted or unsubstituted branched aliphatic hydrocarbon group at each end, a divalent functional group including an ester bond and a urethane bond having a substituted or unsubstituted branched aliphatic hydrocarbon group at each end, a divalent functional group having a substituted or unsubstituted cyclic aliphatic hydrocarbon group at each end and an ester bond, a divalent functional group including an ester bond and a urethane bond having a substituted or unsubstituted cyclic aliphatic hydrocarbon group at each end, a divalent functional group including an ester bond having a substituted or unsubstituted aromatic hydrocarbon group at each end, a divalent functional group including an ester bond and a urethane bond having a substituted or unsubstituted aromatic hydrocarbon group at each end, a divalent functional group including an ester bond having a substituted or unsubstituted diphenylmethylene group at each end, or a divalent functional group including an ester bond and a urethane bond having a substituted or unsubstituted diphenylmethylene group at each end, (Formula 2)

(2)

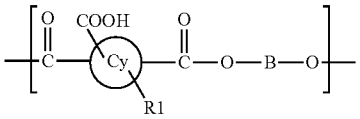

wherein: Cy is a saturated 4 to 6 atom hydrocarbon ring, an unsaturated 4 to 6 atom hydrocarbon ring, or a biphenyl group;

and R1 and B are the same as in Formula 1, (Formula 3)

(3)

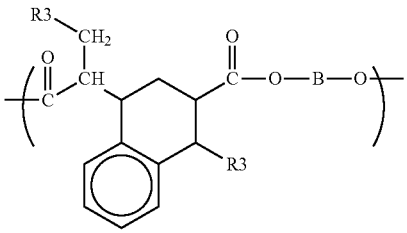

wherein:

one R3 is a hydrogen atom, a carboxyl group, a substituted or unsubstituted linear aliphatic hydrocarbon group, a substituted or unsubstituted branched aliphatic hydrocarbon group, a substituted or unsubstituted cyclic aliphatic hydrocarbon group, or a substituted or unsubstituted aromatic hydrocarbon group;

another R3 is a carboxyl group; and

B is the same as in Formula 1, (Formula 4)

(4)

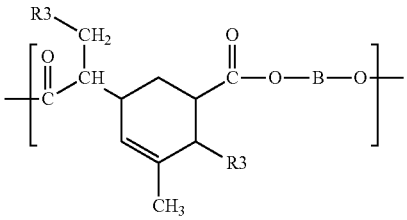

wherein:

R3 is the same as in Formula 3; and

B is the same as in Formula 1, (Formula 5)

(5)

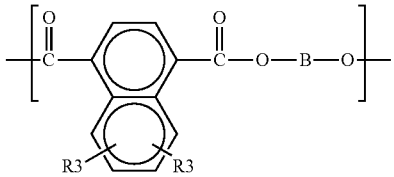

wherein, R3 and B are the same as in Formula 4, (Formula 6)

(6)

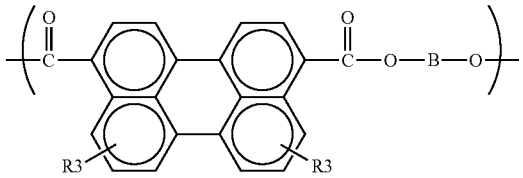

wherein, R3 and B are the same as in Formula 4, (Formula 7)

(7)

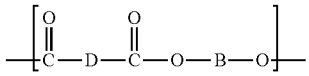

wherein:

D is a divalent saturated or unsaturated linear or branched aliphatic hydrocarbon group of which at least one hydrogen atom is substituted by a carboxyl group; and B is the same as in Formula 1.

4. The toner of claim 3, wherein:

B has a substituent group, and the substituent group is a divalent hydrocarbon group with a carbon number of 1 to 10.

5. The toner of claim 3, wherein:

a content of the structural unit in the amorphous polyester-based resin is in a range of from 0.02 mol/kg to 0.35 mol/kg.

6. The toner of claim 1, wherein:

the binder resin comprises a crystalline polyester resin;

an endothermic amount in the fusing of the crystalline polyester resin as determined by differential scanning calorimetry (DSC) is in a range of 2.0 to 10.0 W/g;

a weight average molecular weight of the crystalline polyester resin is in a range of 5,000 to 15,000;

in an endothermic curve for the differential scanning calorimeter measurement, a difference between an endothermic start temperature and an endothermic peak temperature of the crystalline polyester resin when the temperature is increased is in a range of 3 to 5° C.;

the crystalline polyester resin comprises a sulfur element, a fluorine element or both; and a content of the crystalline polyester resin having a weight average molecular weight of 1,000 or less is in a range of from 1% to less than 10% by weight based on the weight of the crystalline polyester resin.

7. The toner of claim 1 further comprising, a coating layer disposed on the outer surface of the toner, and the coating layer comprises the amorphous polyester-based resin.

8. The toner of claim 7, wherein:

the coating layer has a thickness of 0.2 to 1.0 μm.

9. The toner of claim 1, wherein:

the toner for developing the electrostatic charge image has an acid value of 3 to 25 mgKOH/g.

10. The toner of claim 1, wherein:

the toner has a volume average particle size in a range of 3 to 9 μm;

an amount of particles having a particle size 3 μm or less as a number average particle size is in a range of 3 number percent or less; and a ratio of the amount of the particles having the particle size of 3 μm or less to the amount of the particles having the particle size of 1 μm or less as the number average particle size is in a range of 2.0 to 4.0.

11. A method of manufacturing a toner of claim 1 for developing an electrostatic charge image, the method comprising:

an amorphous polyester-based resin synthesis process in which a first polycarboxylic acid component and a polyol component are dehydration-condensed at a temperature of 150° C. or less in a presence of a catalyst, wherein (i) a resin obtained by the dehydration condensation urethane-extends in a presence of the polyisocyanate component, then extends by the second polycarboxylic acid component having a substituent group corresponding to three or more carboxyl groups, and the amorphous polyester-based resin is synthesized, or (ii) the resin obtained by the dehydration condensation extends by the second polycarboxylic acid component having a substituent group corresponding to three or more carboxyl groups, then urethane-extends in the presence of the polyisocyanate component, such that the amorphous polyester-based resin is synthesized;

an amorphous polyester-based resin latex formation process of forming a latex of the amorphous polyester-based resin;

a crystalline polyester resin synthesis process in which an aliphatic polycarboxylic acid component and an aliphatic polyol component are dehydration-condensed at a temperature of 100° C. or less in a presence of a catalyst, and the crystalline polyester resin is synthesized;

a crystalline polyester resin latex formation process of forming a latex of the crystalline polyester resin;

a mixture solution formation process of mixing at least the amorphous polyester-based resin latex and the crystalline polyester resin latex to form the mixture solution;

a first aggregation particle formation process in which the amorphous polyester-based resin and the crystalline polyester resin are aggregated by adding a flocculant to the mixture solution to form the first aggregation particle;

a coated aggregation particle formation process providing a coating layer formed of the amorphous polyester-based resin on the surface of the first aggregation particle to form a coated aggregation particle, and a fusion unity process fusion-uniting the coated aggregation particle at a temperature higher than the glass transition temperature of the amorphous polyester-based resin, wherein:

the aromatic ring concentration of the amorphous polyester-based resin is in a range of 4.5 to 5.8 mol/kg;

the weight average molecular weight (MW) of the amorphous polyester-based resin is in a range of 7,000 to 50,000;

the glass transition temperature (Tg) of the amorphous polyester-based resin is in a range of 50 to 70° C.;

Equation 1 is satisfied if the weight average molecular weight (MW) of the amorphous polyester-based resin is in a range from 7,000 or more to less than 14,000, and Equation 2 is satisfied if the weight average molecular weight (MW) of the amorphous polyester-based resin is in a range from 14,000 or more to 50,000 or less;

an endothermic amount in the fusing of the crystalline polyester resin as determined by the differential scanning calorimetry is in a range of 2.0 to 10.0 W/g;

a weight average molecular weight of the crystalline polyester resin is in a range of 5,000 to 15,000;

for the endothermic curve found by the differential scanning calorimetry, the difference between the endothermic start temperature and the endothermic peak temperature of the crystalline polyester resin while increasing the temperature is in a range of 3 to 5° C.;

the crystalline polyester resin includes a sulfur element, a fluorine element or both; and the content of the crystalline polyester resin having a weight average molecular weight of 1,000 or less is in a range of from 1% to less than 10%, by weight based on the weight of the crystalline polyester resin the catalyst comprising one or more elements selected from a group consisting of the sulfur element and the fluorine element, and the flocculant comprising the iron element and the silicon element:

$$Tg=7.26\times\ln(MW)+a \text{ (where } -19.33\leq a\leq -4.29) \quad \text{(Equation 1)}$$

$$Tg=2.67\times\ln(MW)+b \text{ (where } 21.07\leq b\leq 39.48). \quad \text{(Equation 2)}$$

12. A toner for developing an electrostatic charge image, the toner comprising:

toner particles comprising:

a binder resin comprising an amorphous polyester-based resin, the amorphous polyester-based resin having an aromatic ring concentration in a range of 4.5 to 5.8 mol/kg, a weight average molecular weight (MW) of the amorphous polyester-based resin being in a range of 7,000 to 50,000, and a glass transition temperature (Tg) of the amorphous polyester-based resin being in a range of 50 to 70° C.; and three or more elements comprising iron, silicon and sulfur, wherein an iron element content in the toner is in a range of $1.0\times10^3$ to $1.0\times10^4$ ppm, a silicon element content in the toner is in a range of $1.0\times10^3$ to $8.0\times10^3$ ppm, and a sulfur element content in the toner is in a range of 500 to 3,000 ppm, based on a total weight of the toner particles.

13. The toner of claim 12, wherein the weight average molecular weight (MW) of the amorphous polyester-based resin is in a range of 7,000 or more to less than 14,000, and the amorphous polyester-based resin satisfies Equation 1:

$$Tg=7.26\times\ln(MW)+a \text{(where } -19.33\leq a\leq -4.29). \quad \text{(Equation 1)}$$

14. The toner of claim 12, wherein the weight average molecular weight (MW) of the amorphous polyester-based resin is in a range of 14,000 or more to 50,000 or less, and the amorphous polyester-based resin satisfies Equation 2:

$$Tg=2.67\times\ln(MW)+b(\text{where } 21.07\leq b\leq 39.48). \quad \text{(Equation 2)}$$

15. The toner of claim 12, further comprising fluorine, wherein a fluorine element content in the toner is in a range of $1.0\times10^3$ to $1.0\times10^4$ ppm based on the total weight of the toner particles.

* * * * *